US010538964B2

(12) United States Patent
Tsujimoto et al.

(10) Patent No.: US 10,538,964 B2
(45) Date of Patent: Jan. 21, 2020

(54) DAYLIGHTING DEVICE AND DAYLIGHTING SYSTEM

(71) Applicant: SHARP KABUSHIKI KAISHA, Sakai, Osaka (JP)

(72) Inventors: Masahiro Tsujimoto, Sakai (JP); Tsuyoshi Kamada, Sakai (JP); Shun Ueki, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/096,260

(22) PCT Filed: Apr. 26, 2017

(86) PCT No.: PCT/JP2017/016558
§ 371 (c)(1),
(2) Date: Oct. 24, 2018

(87) PCT Pub. No.: WO2017/188318
PCT Pub. Date: Nov. 2, 2017

(65) Prior Publication Data

US 2019/0162020 A1 May 30, 2019

(30) Foreign Application Priority Data

Apr. 27, 2016 (JP) ..... 2016-089662

(51) Int. Cl.
*E06B 9/386* (2006.01)
*E06B 9/264* (2006.01)
(Continued)

(52) U.S. Cl.
CPC ..... *E06B 9/386* (2013.01); *E06B 9/264* (2013.01); *E06B 9/28* (2013.01); *E06B 9/303* (2013.01);
(Continued)

(58) Field of Classification Search
CPC ..... F21S 11/00
(Continued)

(56) References Cited

U.S. PATENT DOCUMENTS 4,799,526 A * 1/1989 Reeves ..... B29C 53/043 160/168.1 R
4,841,672 A * 6/1989 Nebhuth ..... E06B 9/32 49/25
(Continued)

FOREIGN PATENT DOCUMENTS

JP H07-307106 A 11/1995
JP 2000-096956 A 4/2000
(Continued)

OTHER PUBLICATIONS

Ueki et al, ISA Written Opinion, 'Daylighting Device and Daylighting Slat', PCT/JP2017/016558, Jan. 8, 2017, 9 pgs (Year: 2017).*

*Primary Examiner* — Clayton E. LaBalle
*Assistant Examiner* — Kevin C Butler
(74) *Attorney, Agent, or Firm* — ScienBiziP, P.C.

(57) ABSTRACT

The present invention, in one aspect thereof, is directed to a daylighting device including: a first, transparent slat configured to bend an optical path of incident outdoor light so as to emit the light in a prescribed indoor direction; a first drive mechanism configured to drive the first slat; and a control unit configured to control the first drive mechanism so as to change an angle of inclination of the first slat in accordance with a position of the sun.

21 Claims, 33 Drawing Sheets

(51) Int. Cl.

| | |
|---|---|
| ***E06B 9/303*** | (2006.01) |
| ***F21V 5/02*** | (2006.01) |
| ***E06B 9/28*** | (2006.01) |
| ***F21S 11/00*** | (2006.01) |
| ***F21V 14/06*** | (2006.01) |
| ***F21V 23/04*** | (2006.01) |
| ***E06B 9/322*** | (2006.01) |
| *E06B 9/24* | (2006.01) |

(52) U.S. Cl.
CPC ..... *E06B 9/322* (2013.01); *F21S 11/00* (2013.01); *F21S 11/007* (2013.01); *F21V 5/02* (2013.01); *F21V 14/06* (2013.01); *F21V 23/0464* (2013.01); *E06B 2009/2417* (2013.01); *E06B 2009/2643* (2013.01)

(58) Field of Classification Search
USPC ..... 359/592
See application file for complete search history.

(56) References Cited

U.S. PATENT DOCUMENTS 6,239,910 B1 * 5/2001 Digert ..... E06B 9/28 160/104
6,561,254 B1 * 5/2003 Liu ..... E06B 9/322 160/177 R
7,481,552 B2 * 1/2009 Mayfield, III ..... F21S 8/04 362/223
7,758,227 B1 * 7/2010 Coleman ..... G02B 5/0242 362/606
8,040,610 B2 * 10/2011 Ko ..... E06B 9/24 359/592
8,430,548 B1 * 4/2013 Kelly ..... G02B 5/0242 362/606
2003/0112518 A1 * 6/2003 Rogers ..... E06B 9/28 359/596
2008/0202703 A1 * 8/2008 Edmonds ..... E06B 9/386 160/168.1 R
2013/0265642 A1 * 10/2013 Vasylyev ..... G02B 19/0042 359/595
2014/0111851 A1 * 4/2014 Lin ..... E06B 9/386 359/359
2014/0133030 A1 * 5/2014 Gardiner ..... G02B 5/045 359/592
2015/0049387 A1 * 2/2015 Kashiwagi ..... B29C 43/021 359/592
2016/0186949 A1 * 6/2016 Sekido ..... E06B 9/28 359/597
2016/0273724 A1 * 9/2016 Sakuragi ..... E06B 3/66
2017/0023197 A1 * 1/2017 Ueki ..... G02B 5/0215
2017/0114590 A1 * 4/2017 Shinozaki ..... E06B 9/24
2017/0130920 A1 * 5/2017 Tsujimoto ..... E06B 5/00
2017/0138124 A1 * 5/2017 Kanno ..... E06B 9/386
2017/0146208 A1 * 5/2017 Ueki ..... B32B 7/05
2017/0307160 A1 * 10/2017 Ueki ..... E06B 9/24
2017/0314752 A1 * 11/2017 Yui ..... E06B 9/24
2017/0362883 A1 * 12/2017 Kanno ..... E06B 3/67
2018/0119486 A1 * 5/2018 Kanno ..... E06B 5/00
2018/0128441 A1 * 5/2018 Nishinaka ..... E06B 3/6715
2018/0142517 A1 * 5/2018 Shinozaki ..... B32B 7/02
2018/0170012 A1 * 6/2018 Ueki ..... C03C 27/06
2018/0231203 A1 * 8/2018 Ueki ..... E06B 5/00
2018/0259144 A1 * 9/2018 Arai ..... F21S 11/007
2018/0291681 A1 * 10/2018 Kanno ..... E06B 9/266
2018/0313141 A1 * 11/2018 Nishinaka ..... E06B 5/00
2018/0356059 A1 * 12/2018 Ueki ..... E06B 5/00
2019/0041017 A1 * 2/2019 Yui ..... E06B 9/303
2019/0093840 A1 * 3/2019 Kashiwagi ..... B29C 43/021

FOREIGN PATENT DOCUMENTS

JP 2011-196177 A 10/2011
JP 2011196177 * 10/2011 ..... E06B 9/264
JP 2015138747 * 1/2014
JP 2014-044331 A 3/2014
JP 2014-120461 A 6/2014
JP 2015-138747 A 7/2015
WO WO2015098940 * 12/2014 ..... G02B 5/00
WO 2015/076245 A1 5/2015
WO WO-2015076245 A1 * 5/2015 ..... E06B 9/24
WO 2015/098940 A1 7/2015
WO 2016/002869 A1 1/2016

* cited by examiner

DAYLIGHTING DEVICE AND DAYLIGHTING SYSTEM

TECHNICAL FIELD

The present invention, in one aspect thereof, relates to daylighting devices and daylighting systems.

The present application claims priority to Japanese Patent Application, Tokugan, No. 2016-089662 filed in Japan on Apr. 27, 2016, the entire contents of which are incorporated herein by reference.

BACKGROUND ART

Patent Literature 1 discloses a daylighting device for letting sunlight into a room through, for example, a window of a building. The daylighting device described in Patent Literature 1 includes a plurality of daylighting sheets disposed side by side and a pivot mechanism that pivots the daylighting sheets. Patent Literature 1 describes that this daylighting device allows for suitable adjustment of deflection of light in accordance with the angle of elevation of the sun, in order to prevent glaring light from coming into the room.

Meanwhile, in the art of window shades for blocking sunlight, Patent Literature 2 discloses an electric window shade including a slat angle controller that controls the angle of slats in accordance with the time of day, weather, and other conditions.

CITATION LIST

Patent Literature

Patent Literature 1: Japanese Unexamined Patent Application Publication, Tokukai, No. 2014-120461

Patent Literature 2: Japanese Unexamined Patent Application Publication, Tokukai, No. 2011-196177

SUMMARY OF INVENTION

Technical Problem

In the electric window shade of Patent Literature 2, its slats are assumed to be closed, for example, when it is sunny, so that desk workers in the room do not feel the glare of the sun. It is therefore difficult to efficiently admit sunlight into the room using this electric window shade.

In the daylighting device of Patent Literature 1, its slats are rotated so as to turn their upper portions toward the exterior of the room on winter days and in the early morning and the late afternoon when the sun has a low altitude because sunlight may otherwise pass through the daylighting device without hitting its light-deflecting units. On summer days when the sun has a high altitude, the slats are rotated so as to turn their upper portions toward the interior because sunlight may otherwise pass through the daylighting device without being totally reflected by the light-deflecting units. This adjustment of the slats prevents glaring direct light from occurring. It is however difficult in this daylighting device to make direct light emitted in a substantially horizontal direction and thereby guide the light deep into the room, for example, if the slats are rotated until the light strikes the light-deflecting units when the sun has a low altitude. This structure has, among others, the following problems: the light-incident face is vertical (parallel to the base member); the structure is filled with a material having a low refractive index, which exhibits a smaller critical angle for total reflection than air, and a special window shade structure is necessary to allow an upper portion of each slat to rotate to selectively face the interior or exterior of the room depending on the season. It is difficult, as can be understood from the description, to provide a daylighting device that satisfies both of these requirements of reduced glare and efficient daylighting.

An aspect of the present invention has been made to address the problems, and one of its object is to provide a daylighting device and a daylighting system that achieve both reduced glare and efficient daylighting.

Solution to Problem

To achieve the object, the present invention, in one aspect thereof, is directed to a daylighting device including: a first, transparent slat configured to bend an optical path of incident outdoor light so as to emit the incident outdoor light in a prescribed indoor direction; a first drive mechanism configured to drive the first slat; and a control unit configured to control the first drive mechanism so as to change an angle of inclination of the first slat in accordance with a position of the sun.

In the daylighting device in accordance with an aspect of the present invention, the first slat may include a plurality of prismatic structural bodies configured to change a traveling direction of light in a vertical plane.

In the daylighting device in accordance with an aspect of the present invention, the prismatic structural bodies may each have at least: a first face serving primarily as a reflection face for the incident outdoor light and making an angle $\alpha$ with a reference face for the first slat; and a second face serving as an entrance face or an exit face for the incident outdoor light and making an angle $\beta$ with the reference face.

The daylighting device in accordance with an aspect of the present invention may further include a memory unit configured to store either a correlation between a date and time and the angle of inclination of the first slat or a correlation between an angle of incidence of light to the first slat and the angle of inclination of the first slat, wherein the control unit controls the angle of inclination of the first slat based on the correlation stored in the memory unit.

The daylighting device in accordance with an aspect of the present invention may further include a memory unit configured to store an expression, $\theta out=f(\theta in, \varphi in, \gamma)$, representing a correlation between $\theta in$, $\varphi in$, $\gamma$, and $\theta out$, where $\theta in$ is an incident angle of altitude of direct light on a horizontal plane, $\varphi in$ is an incident angle of orientation of the direct light on the horizontal plane, $\gamma$ is the angle of inclination of the first slat, and $\theta out$ is an emission angle of altitude of the direct light that exits the first slat.

In the daylighting device in accordance with an aspect of the present invention, $\gamma$ may have a negative value when the first slat is rotated in such a direction as to tilt an upper portion of the first slat toward an interior of a room and have a positive value when the first slat is rotated in such a direction as to tilt the upper portion toward an exterior of the room, and the control unit may derive a minimum value of $\gamma$ that satisfies $\theta out=f(\theta in, \varphi in, \gamma)\geq 5$, where $\delta$ is an offset angle from the horizontal plane of light exiting the first slat.

In the daylighting device in accordance with an aspect of the present invention, the control unit may determine the offset angle $\delta$ based on a location of a lower end of the first slat and a depth of a room in which the daylighting device is installed.

In the daylighting device in accordance with an aspect of the present invention, the correlation may be related to direct light reflected once inside the prismatic structural bodies.

The daylighting device in accordance with an aspect of the present invention may further include an input unit configured to enable external input of a posture for the first slat, wherein the control unit controls the angle of inclination of the first slat based on the correlation and a signal obtained from the input unit.

In the daylighting device in accordance with an aspect of the present invention, the first and second faces of the prismatic structural bodies may be provided so as to face outdoors, and each of the prismatic structural bodies may have, at least in a part thereof, such a combination of the angles $\alpha$ and $\beta$ that $0° < \alpha \leq 90°$, $0° \leq \beta \leq 90°$, and $\alpha \geq \beta$.

In the daylighting device in accordance with an aspect of the present invention, the angles $\alpha$ and $\beta$ may be such that $64° < \alpha \leq 90°$ and $42° \leq = \leq 90°$.

In the daylighting device in accordance with an aspect of the present invention, the first and second faces of the prismatic structural bodies may be provided so as to face indoors, and each of the prismatic structural bodies may have, at least in a part thereof, such a combination of the angles $\alpha$ and $\beta$ that $0° < \alpha \leq 90°$, $0 \leq \beta \leq 90°$, and $\alpha \leq \beta$.

In the daylighting device in accordance with an aspect of the present invention, the angles $\alpha$ and $\beta$ may be such that $51° < \alpha \leq 83°$ and $33° \leq \beta \leq 90°$.

In the daylighting device in accordance with an aspect of the present invention, the first slat may be bent along a bending line that is parallel to a lengthwise direction of the first slat.

In the daylighting device in accordance with an aspect of the present invention, the first slat may have a first area and a second area separated by the bending line, the prismatic structural bodies may be provided in the first area, and the second area may have a light-absorbing property.

In the daylighting device in accordance with an aspect of the present invention, the second face may have a cross-section, taken perpendicular to a lengthwise direction of the prismatic structural bodies, that has a curved line.

The present invention, in one aspect thereof, is directed to a daylighting device including: a first, transparent slat configured to bend an optical path of incident outdoor light so as to emit the incident outdoor light in a prescribed indoor direction; a second slat provided below the first slat, the second slat being configured to either block the incident outdoor light or transmit the incident outdoor light in a diffuse manner, a drive mechanism configured to drive at least one of the first and second slats; and a control unit configured to control the drive mechanism so as to change an angle of inclination of the at least one of the first and second slats in accordance with a position of the sun, wherein: the first slat includes a plurality of prismatic structural bodies configured to change a traveling direction of light in a vertical plane; and the prismatic structural bodies each have at least: a first face serving primarily as a reflection face for the incident outdoor light and making an angle $\alpha$ with a reference face for the first slat; and a second face serving as an entrance face or an exit face for the incident outdoor light and making an angle $\beta$ with the reference face.

In the daylighting device in accordance with an aspect of the present invention, the second slat may be driven in conjunction with or independently from the first slat so as to change the angle of inclination of the second slat.

The daylighting device in accordance with an aspect of the present invention may further include a direct-light-detection unit configured to detect direct light around the daylighting device, wherein the control unit controls the angle of inclination of the first slat based on the direct light detected by the direct-light-detection unit.

The present invention, in one aspect thereof, is directed to a daylighting system including: the daylighting device in accordance with one aspect of the present invention; and a multilayered glass unit including a pair of opposing glass plates separated by a distance, wherein the daylighting device is provided between the pair of glass plates.

The present invention, in one aspect thereof, is directed to a daylighting system including: the daylighting device in accordance with one aspect of the present invention; an interior lighting fixture; a detection unit configured to detect indoor brightness; and a control unit configured to control the interior lighting fixture and the detection unit, wherein the control unit controls the interior lighting fixture based on an illuminance detected by the detection unit.

Advantageous Effects of Invention

The present invention, in one aspect thereof, provides a daylighting device and a daylighting system that achieve both reduced glare and efficient daylighting.

DESCRIPTION OF EMBODIMENTS

Figure 1:
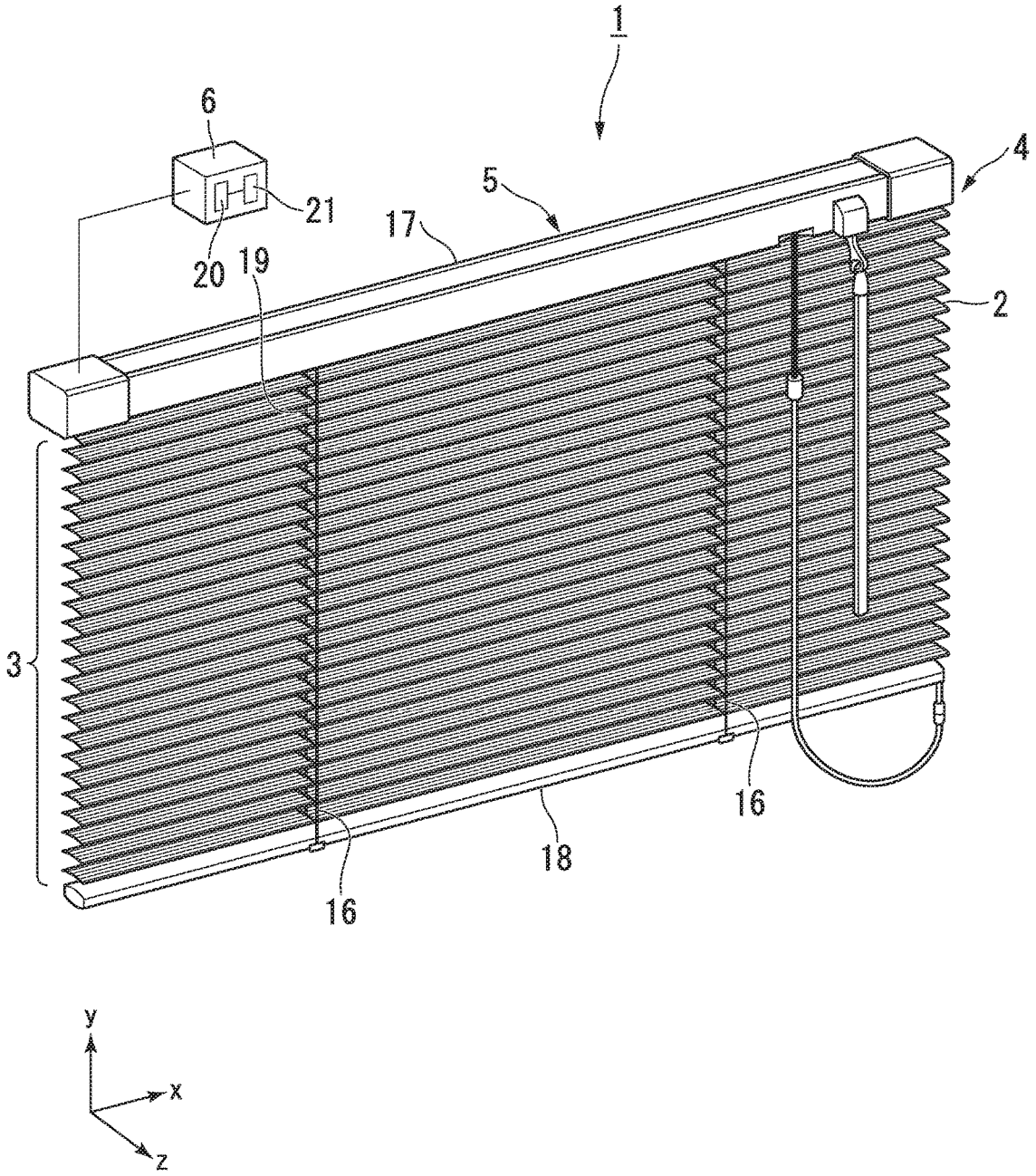
FIG. 1 is a perspective view of a daylighting device in accordance with a first embodiment.

The following will describe embodiments of the present invention in reference to drawings.

In the drawings used in the following description, members are drawn to suitable arbitrary scales to show each member with readily recognizable dimensions.

Throughout the following description, the directional designations such as "upper," "lower," "top," "bottom," "left," "right," "front," and "back" in and around a daylighting device are given as they would be in and around the daylighting device installed for actual use. Unless otherwise specified, these designations in the description match those in and around the daylighting device on the pages on which the daylighting device is drawn.

First Embodiment

The following will describe a first embodiment of the present invention in reference to FIGS. 1 to 12.

FIG. 1 is a perspective view of a daylighting device in accordance with the first embodiment. When a daylighting device 1 in FIG. 1 is viewed from the front, the Y direction runs vertically from top to bottom or vice versa, the X direction from left to right or vice versa, and the Z direction from front to back or vice versa.

Figure 2:
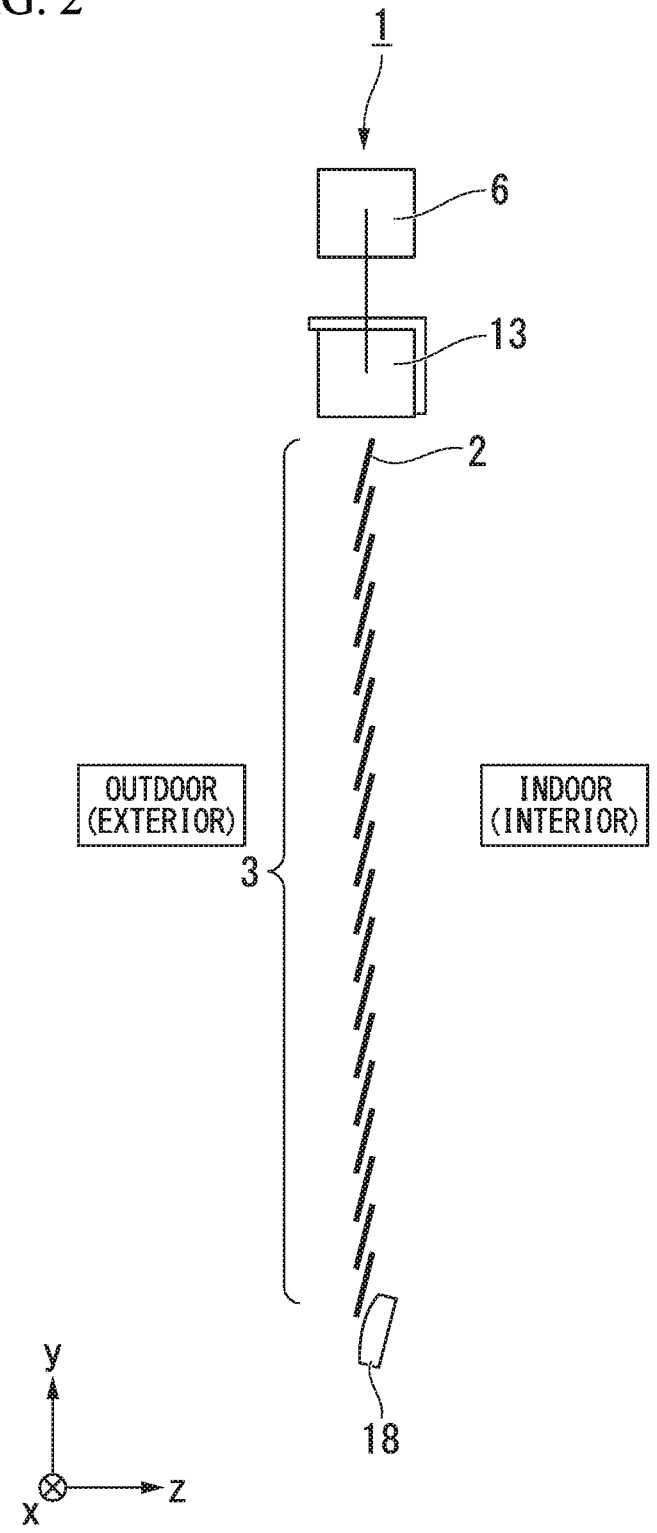
FIG. 2 is a side view of the daylighting device.

FIG. 2 is a side view of the daylighting device in accordance with the first embodiment.

Referring to FIGS. 1 and 2, the daylighting device 1 includes: a daylighting unit 3 composed of a plurality of daylighting slats 2; a supporting mechanism 4; a drive mechanism 5; and a control unit 6. The daylighting slats 2 are suspended vertically (in the Y direction), separated by a distance from each other. Each daylighting slat 2 is disposed so that the length thereof is horizontal (in the X direction). The supporting mechanism 4 supports the daylighting slats 2 in such a manner that the daylighting slats 2 can be moved up and down freely and also be rotated freely. The daylighting slats 2 are structured rotatable such that the upper parts of the daylighting slats 2 can tilt toward the interior of the room.

The daylighting slat 2 in accordance with the present embodiment corresponds to the first slat recited in claims. The drive mechanism 5 in accordance with the present embodiment corresponds to the first drive mechanism recited in claims.

Figure 3A:
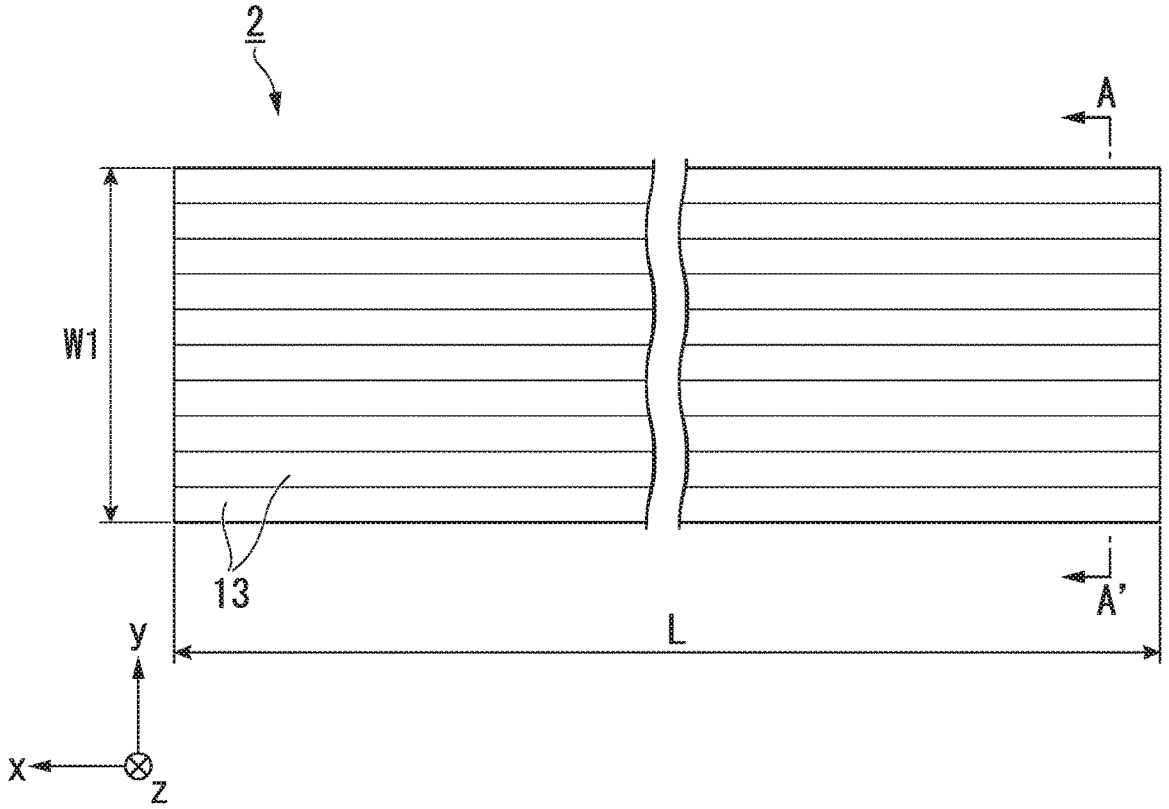
FIG. 3A is a front view of daylighting slats.
Figure 3B:
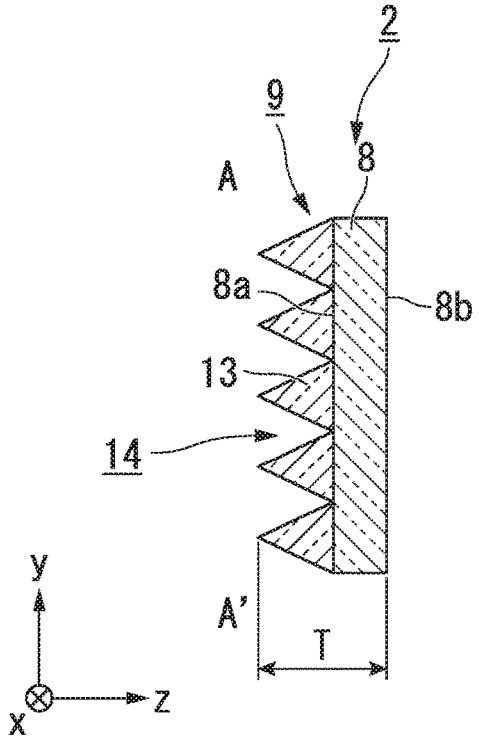
FIG. 3B is a cross-sectional view taken along line A-A' in FIG. 3A.

FIGS. 3A and 3B are schematic views of the structure of the daylighting slats 2. FIG. 3A is a front view, and FIG. 3B is a cross-sectional view taken along line A-A' in FIG. 3A.

Referring to FIGS. 3A and 3B, each daylighting slat 2 includes a transparent base member 8 and a daylighting section 9. The daylighting slat 2 bends the optical path of sunlight coming from the outdoors to emit light in a prescribed indoor direction.

The base member 8 is an elongate platelike member extending in a single direction (X direction). The base member 8 serves as a supporting member that supports the daylighting section 9. The daylighting section 9 is provided on a first face 8*a* of the base member 8.

In the present embodiment, the base member 8 has the first face 8*a* facing the exterior of the room and a second face 8*b* facing the interior of the room. The daylighting section 9 is hence provided on the outdoor side of the base member 8. Alternatively, the daylighting section 9 may be provided on the indoor side of the base member 8. As a further alternative, the daylighting section 9 and the base member 8 may be provided separately or formed integrally as a single piece.

Each daylighting slat 2 has a length L of, for example, approximately 50 to 3000 mm in the lengthwise direction thereof.

The daylighting slat 2 has a length (slat width) W of, for example, approximately 15 to 35 mm in the widthwise direction thereof. The daylighting slat 2 has a thickness T of, for example, approximately 0.1 to 3 mm.

Referring to FIG. 3B, the daylighting section 9 includes a plurality of prismatic structural bodies 13 and a gap portion 14. The prismatic structural bodies 13 transmit light. The gap portion 14 is a space between adjacent prismatic structural bodies 13 and contains air. Although FIG. 3B and subsequent drawings show only five prismatic structural bodies 13, the daylighting section 9 in reality includes more prismatic structural bodies 13.

The prismatic structural bodies 13 are made of a transparent and photosensitive organic material such as acrylic resin, epoxy resin, or silicone resin. Alternatively, these organic materials may be mixed with a polymerization initiator, a coupling agent, a monomer, or an organic solvent for use. The polymerization initiator may contain various additives such as a stabilizer, an inhibitor, a plasticizer, a fluorescent whitening agent, a release agent, a chain transfer agent, and another photopolymerizable monomer. Those materials described in Japanese Patent No. 4129991 may also be used. The prismatic structural bodies 13 preferably have a total light transmittance of 90% or greater when measured as specified in JIS K7361-1, which gives sufficient transparency.

Figure 4:
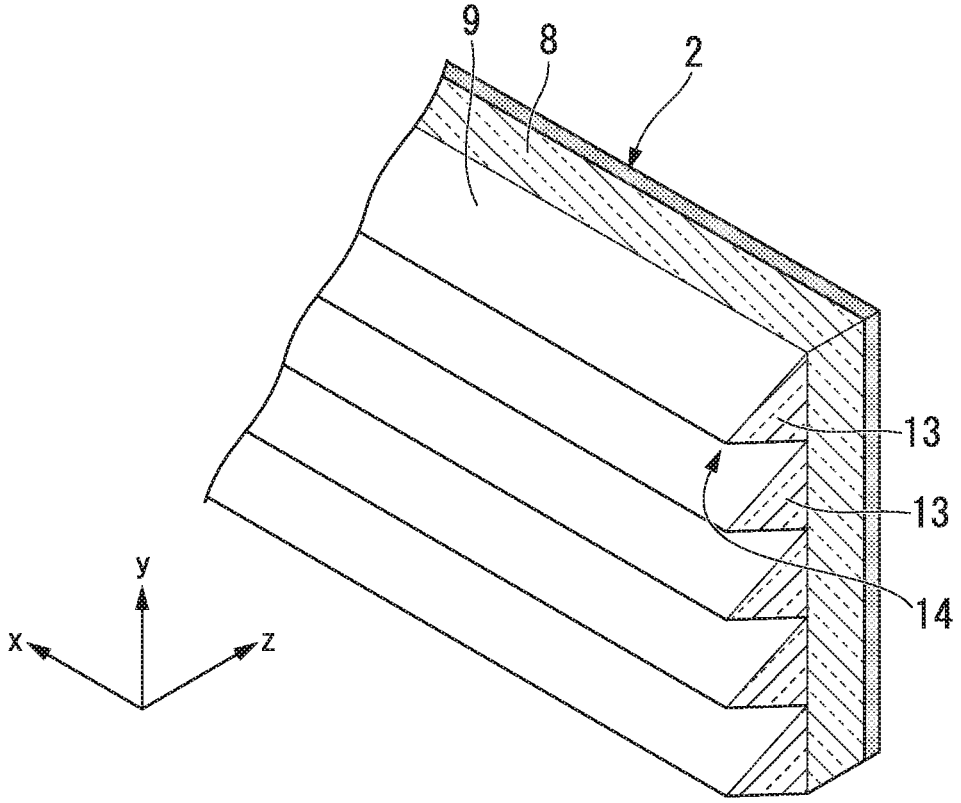
FIG. 4 is a perspective view of one of the daylighting slats.
Figure 5:
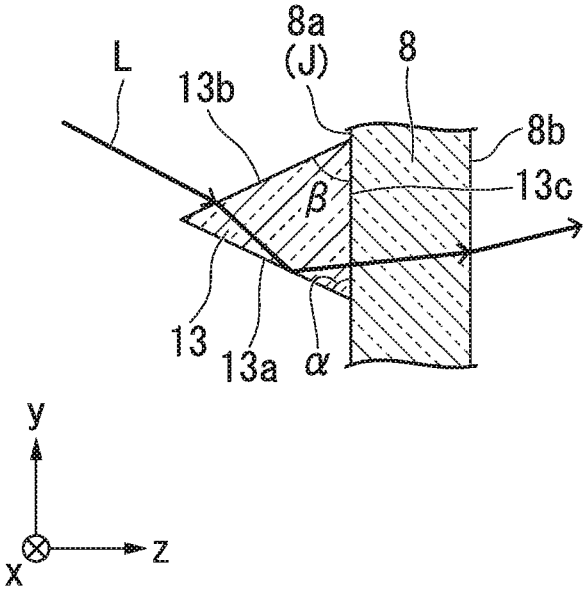
FIG. 5 is a cross-sectional view of a daylighting section.

Referring to FIGS. 4 and 5, the prismatic structural bodies 13 extend in the lengthwise direction (X direction) of the daylighting slat 2 and are arranged next to each other when traced in the widthwise direction (Y direction) of the daylighting slat 2. Each prismatic structural body 13 is a transparent structural body shaped like a triangular prism. In other words, the prismatic structural body 13 is triangular when viewed in a cross-section thereof taken perpendicular to the length thereof. The prismatic structural body 13 changes the traveling direction of incoming sunlight in a vertical plane. As will be described later in detail, the prismatic structural body 13 does not necessarily have a shape that resembles a triangular prism and may be shaped, for example, like any polygonal (non-triangular) prism.

Referring to FIG. 5, the prismatic structural body 13 has: a first face 13*a* serving primarily as a reflection face that reflects off incident light; a second face 13*b* serving primarily as an entrance face on which sunlight is incident; and a third face 13*c* that is in contact with the first face 8*a* of the base member 8. Throughout the following description, the first face 8*a* of the base member 8 will be used as a reference face 1 for the daylighting slat 2. The reference face J makes an angle $\alpha$ of approximately 51° to 90° with the first face 13*a* and an angle $\beta$ of approximately 33° to 90° with the second face 13*b*. The angle $\alpha$ is not necessarily equal to the angle $\beta$.

Sunlight L, after passing through window glass, may possibly take various paths between the entrance to the prismatic structural body 13 and the exit from the base member 8, a typical one of which is shown in FIG. 5. Referring to FIG. 5, sunlight L having passed through window glass enters the prismatic structural body 13 through the second face 13*b*, reflects off the first face 13*a*, then enters the base member 8, and exits the base member 8 through the second face 8*b*.

In this example, there exists air between adjacent prismatic structural bodies 13. These air-containing portions form the gap portion 14. In an alternative structure, the portions between adjacent prismatic structural bodies 13 may be filled with a low-refractive-index material other than air. However, the difference in refractive index at the interface between the prismatic structural bodies 13 and the gap portion 14 is a maximum when there is air in the gap portion 14 than there is any other low-refractive-index material in the gap portion 14. That, according to Snell's law, means that the critical angle of light on the first face 13*a* is a minimum when there is air in the gap portion 14 between the prismatic structural bodies 13 as shown in FIG. 5.

When there is air in the gap portion 14, the range of the angle of incidence of light L that is totally reflected off the first face 13*a* becomes broadest, and the light incident to the prismatic structural body 13 is efficiently guided to the second face 8*b* side of the base member 8.

That restrains loss of light L incident to the prismatic structural body 13 and increases the intensity of light exiting the base member 8 through the second face 8*b*.

The refractive index of the base member 8 is preferably substantially equal to the refractive index of the prismatic structural bodies 13. In other words, the base member 8 and the prismatic structural bodies 13 are preferably formed integrally as a single piece. For example, if the refractive index of the base member 8 differs much from the refractive index of the prismatic structural bodies 13, light, upon entering the base member 8 from the prismatic structural bodies 13, may be undesirably refracted or reflected at the interface between the prismatic structural bodies 13 and the base member 8. When this is actually the case, problems could occur including reduced luminance and a failure to achieve desired daylighting properties.

Referring back to FIG. 1, the supporting mechanism 4 includes: sets of parallel ladder cords 16 arranged vertically (in the Y direction) side by side; a headbox 17 holding the upper ends of the sets of ladder cords 16; and an up/down bar 18 attached to the lower ends of the sets of ladder cords 16.

The drive mechanism 5 is contained inside the headbox 17. The drive mechanism 5 includes, for example: a rotation drum (not shown) that rotates the daylighting slats 2; an up/down drum (not shown) that moves up and down the daylighting slats 2; and a motor (not shown) that rotates the rotation drum and the up/down drum.

The control unit 6 includes a central processing unit 20 and a memory 21. The control unit 6 computes an angle of inclination for the daylighting slats 2 for each time of day in the central processing unit 20 and controls the rotation drum in the drive mechanism 5 to change the angle of inclination of the daylighting slats 2 in accordance with the position of the sun.

The memory 21 contains, in the form of a mathematical expression or table, any of (1) a correlation between the angle of incidence of light (angle of incidence to a horizontal plane and angle of orientation of light incident to a light-receiving face), the angle of inclination of the daylighting slats 2, and the angle of emergence of light; (2) a correlation between the angle of incidence of light and the angle of inclination of the daylighting slats 2; and (3) a correlation between the date and time and the angle of inclination of the daylighting slats 2, as an example.

The memory 21 in accordance with the present embodiment corresponds to the memory unit in claims.

Correlation (3) is obtained by specifying the position of the sun as observed from the installation site, the orientation of the installation face, and the offset angle in advance and for this reason requires installation personnel to repeat the specification of the values of these parameters at every installation site.

Correlation (2) does not need to be prepared for every installation area because the position of the sun can be automatically calculated, for example, from the longitude and latitude of the installation site given by the GPS. In addition, because the orientation of the installation face can be determined using geomagnetism sensors, correlation (2) can automatically accommodate to changes in the orientation of the installation face. However, if the offset angle δ is set in accordance with the size of the building (e.g., the offset angle δ is set to a small value if the room has a long depth and to a large value if the room has a short depth, in order to illuminate the whole room), the memory needs to contain a different set of parameter values for every offset angle δ.

Correlation (1) obviates the need for installation personnel to repeat the specification of parameter values, allows the user to freely set the offset angle δ, and enables automatic updating of parameter values through simple modification of settings for the position of the sun, the orientation of the installation face, and the offset angle. Correlation (1) is therefore the most versatile. Neither correlation (1) nor (2) necessitates the repeated computation of parameter values for each time of day. The computation is done only once upon the installation of the daylighting device, and thereafter, a correlation table will serve the intended purpose. After the installation, the computation is repeated only when there is a change in the set of parameters.

The memory 21 may further contain, for example, a table of information on the daylighting device 1 including, for example, the width and pitch of the daylighting slats 2.

The daylighting device 1, structured as described above, is installed over either the indoor- or outdoor-face of the window glass, hanging down from the top portion of, for example, a window sash. If the daylighting device 1 is installed over the indoor-face of the window glass, the daylighting slats 2 may be arranged either so that those faces thereof on which the prismatic structural bodies 13 are provided can face the interior of the room or so that the faces can face the exterior.

The daylighting device 1 in accordance with the first embodiment is capable of controlling the angle of inclination of the daylighting slats 2 such that the sunlight (direct light) entering the daylighting device 1 can exit the daylighting device 1 in a direction that is upward or downward as much as the offset angle (detailed later) with respect to a horizontal plane that is parallel to the floor surface of the room on any date and at any time of day.

The daylighting device 1 may be equipped with a remote controller for setting the offset angle. Using the remote controller, the user can adjust the angle of inclination of the daylighting slats 2 in accordance with brightness and glare in the room.

Electrically driven light-blocking window shades equipped with a remote controller are conventionally known, as an example. These light-blocking window shade only reflects light and therefore has a generally linear relation between the slat angle and the angle of emergence. In contrast, a daylighting device like the one in the present embodiment refracts light as well as reflects light and therefore has a non-linear relation between the slat angle and the angle of emergence. It varies depending on the date and time, by how many degrees the slat angle should be changed to achieve a desired change of the angle of emergence, for example, by 1°. The daylighting device 1 in accordance with the first embodiment addresses this problem by providing a known correlation between the angle of emergence, the angle of incidence of light, and the angle of slat inclination and hence enables such control that a desired angle of emergence can be achieved throughout the year.

In the following description, a "light-receiving face" refers to an imaginary plane determined by the extension direction of the daylighting slats 2 (X direction) and the arrangement direction of the daylighting slats 2 (Y direction). In the present embodiment, the light-receiving face always matches a vertical plane irrespective of the angle of inclination of the daylighting slats 2.

For ease of description, the following description will assume that the sun's bearing and the orientation of the direction of a normal to the reference face J for the daylighting slat 2 make an angle of 0°.

Let θs_in represent an incident angle of altitude of light on a plane K that is perpendicular to the reference face J for the daylighting slat 2 and θs_out represent an emission angle of altitude of light on the plane K that is perpendicular to the reference face J. The reference face J in this context refers to the first face 8*a* of the base member 8 in the daylighting slat 2 as described earlier.

Also, let θh_in represent an incident angle of altitude of light on a horizontal plane H and θh_out represent an emission angle of altitude of light on the horizontal plane H. The horizontal plane H in this context refers to a plane that matches a plane determined by the horizon of a horizontal coordinate system. The direction that is perpendicular to the horizontal plane H therefore matches the zenith direction. In this case, the direction of the ceiling from the daylighting device 1 is an equivalent of the zenith direction, whereas the direction of the floor therefrom is an equivalent of the nadir direction.

With the altitude of the sun being unchanged, the incident angle of altitude of light θs_in and the emission angle of altitude of light θs_out on the plane K that is perpendicular to the reference face J for the daylighting slat 2 can be changed by the rotation of the daylighting slat 2. In contrast, the incident angle of altitude of light θh_in and the emission angle of altitude of light θh_out on the horizontal plane H do not change with the rotation of the daylighting slat 2.

The incident angle of altitude of light θh_in on the horizontal plane H is an equivalent of the sun's altitude.

In conventional electric window shades, slats are often made of a metal or wooden material.

The angle of the slats is therefore controlled basically to block direct light. Conventional slats therefore provide almost no daylighting effect. In contrast, the daylighting device 1 in accordance with the first embodiment both reduces glare and achieves efficient daylighting by guiding direct light into the room.

The following will describe effects of rotating the daylighting slats 2 in the daylighting device 1.

The horizontal plane H in the following matches a plane determined by the horizon of a horizontal coordinate system and is parallel to a floor surface of a building.

As described in Patent Literature 1 introduced earlier, in a conventional daylighting device equipped with fixed transparent slats, the angle of emergence of light varies with a change in the position of the sun. The conventional daylighting device therefore does not efficiently guide direct light deep into the room.

Figure 6A:
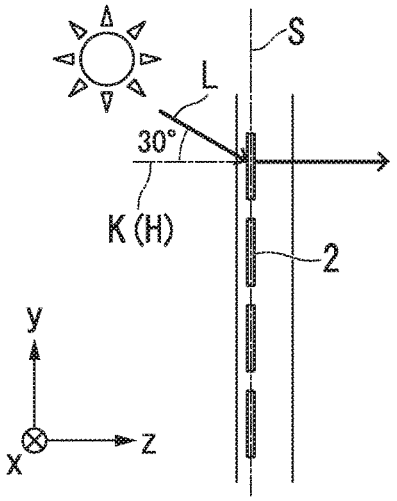
FIG. 6A is a first illustration of effects of the daylighting device.

As an example, assume, as shown in FIG. 6A, that the daylighting slats 2 be not inclined with respect to a vertical plane S and also that if Incident Angle of Altitude of Sunlight $$L\theta s_in=\theta h_in-30°,$$

it then follow that

Emission Angle of Altitude of Sunlight $$L\theta s_out=\theta h_out=0°,$$

and assume further that Δθs_in=Δθs_out, where Δθs_in is the amount of change in the incident angle of altitude of sunlight L on the plane K that is perpendicular to the reference face J, and Δθs_out is the amount of change in the emission angle of altitude of sunlight L on the plane K that is perpendicular to the reference face J. In other words, assume that there exist a relation represented by θs_out=θs_in−30°.

Figure 6B:
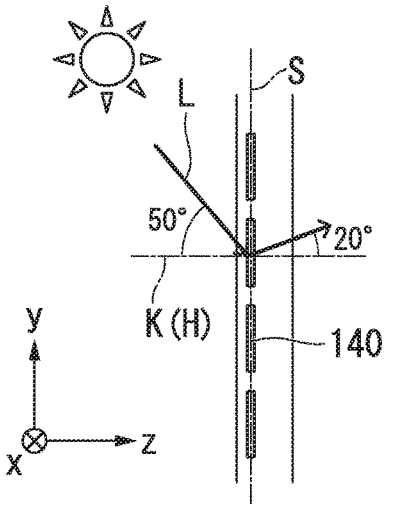
FIG. 6B is a second illustration of effects of the daylighting device.

Under these assumptions, in a daylighting device equipped with daylighting slats 140 that do not tilt (i.e., daylighting device with fixed slats) as a comparative example, if the incident angle of altitude of light θh_in on the horizontal plane H equals 50°, the emission angle of altitude of sunlight L θh_out on the horizontal plane H equals 20° as shown in FIG. 6B. As the sun's altitude increases, that is, as the angle of incidence of sunlight L increases, the angle of emergence also increases. Therefore, the sunlight L admitted indoors travels away from the horizontal plane FI and toward the vicinity of the window, therefore hardly illuminating the deep part of the room.

Figure 6C:
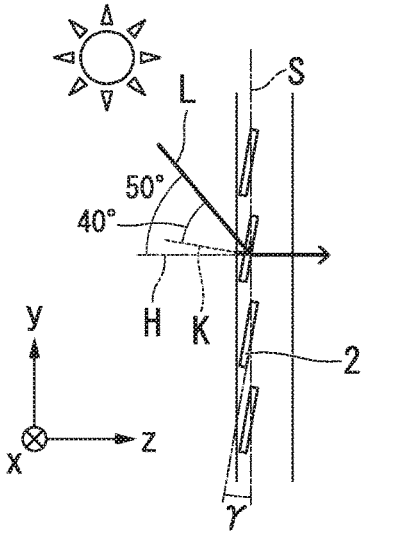
FIG. 6C is a third illustration of effects of the daylighting device.

In contrast, the daylighting device 1 in accordance with the present embodiment is structured to allow the daylighting slats 2 to incline under the control of the control unit 6. Therefore, if the daylighting slats 2 are rotated to a rotation angle γ of 10° when the incident angle of altitude of light θh_in on the horizontal plane FI equals 50°, the incident angle of altitude θs_in on the plane K that is perpendicular to the reference face J equals 40° as shown in FIG. 6C. Under the same conditions, the emission angle of altitude θs_out on the plane K that is perpendicular to the reference face J equals 10. Consequently, the emission angle of altitude θh_out on the horizontal plane H equals 0°. Variations in the sun's altitude can be cancelled out in this manner by the rotation (inclination) of the daylighting slats 2, which enables stable illumination of the deep part of the room. The rotation angle γ of the daylighting slats will be referred to as the slat rotation angle γ in the following description.

An example method of computing the slat rotation angle γ has been described above assuming that there exist a relation, θs_out−θs_in−30°, when the angle made by the sun's bearing and the orientation of the direction of a normal to the reference face J for the daylighting slat 2 is 0°. This example is for illustrating the effects of the daylighting device 1 in accordance with the present embodiment and holds true only when the sun's bearing and the orientation of the direction of a normal to the reference face J makes an angle of 0°.

The following will describe a more general example of a method of controlling the daylighting slats 2 by the control unit 6. The description will take the concept of orientation into account. In addition, the following description will not rely on the system of altitude and orientation using the daylighting slat 2 as a reference and will instead express all altitudes and orientations by using θh_in, φh_in, θh_out, φh_out, and other angles that use a horizontal plane as a reference. Therefore, θh_in, φh_in, θh_out, and φh_out will be simply written as θin, φin, θout, and φout below, by omitting the suffix, h, therein.

The following example assumes that the daylighting device 1 be installed over a side window that has a light-receiving face perpendicular to a floor surface of a building. It should be understood however that calculations are possible in the following design by using angles off a floor surface, regardless of whether or not the floor surface is perpendicular to the light-receiving face.

Conversion of coordinates between an orthogonal coordinate system and a horizontal coordinate system is performed as follows.

Figure 7:
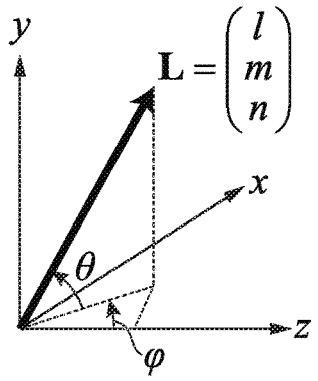
FIG. 7 is a diagram representing conversion of coordinates from one coordinate system to another.

Referring to FIG. 7, letting θ represent the angle between vector L and the x-z plane of an xyz orthogonal coordinate system, and φ represent an angle between the z-axis and the projection of vector L onto the x-z plane, the conversion of coordinates for vector L from the orthogonal coordinate system to a horizontal coordinate system is given by Eq. (5).

$$L=\begin{pmatrix} l \\ m \\ n \end{pmatrix}=\begin{pmatrix} \cos\theta\cdot\sin\varphi \\ \sin\theta \\ \cos\theta\cdot\cos\varphi \end{pmatrix} \tag{5}$$

Expressions for a beam of light in a three-dimensional space may be prepared as follows.

Figure 8:
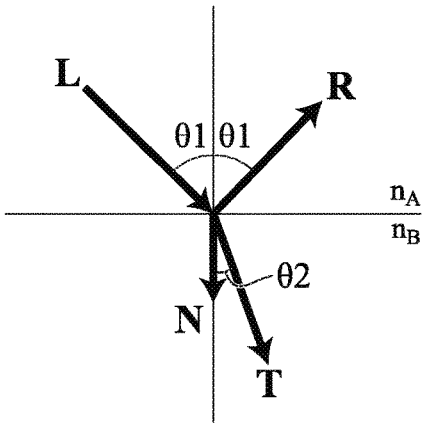
FIG. 8 is a diagram showing traveling directions of light as represented by vectors.

Referring to FIG. 8, let vector L represent incident light on an interface where refractive index changes from $n_A$ to $n_B$ or vice versa, vector R represent reflected light, and vector T represent refracted light. "N" denotes a normal vector that is specified in such a manner that normal vector N makes an angle of less than or equal to 90° with incident light vector L. The material that forms the emission side of a base member has a refractive index $n_C$.

From the law of reflection, Eq. (6) below is derived.

$$R=L-2cN \tag{6}$$

$$|L|=|R|=n_A$$

$$T=n_B$$

$$|N|=1$$

$$c=N\cdot L$$

The magnitude of each light beam vector |L|, |R|, and |T| equals the refractive index of a medium. Specifically, $|L|=|R|=n_A$, and $|T|=n_B$. The magnitude of a normal vector |N| equals 1.

Eq. (7) below is derived from a light-beam-refraction equation (Snell's law in a three-dimensional space).

$$N\times T=(n_A/n_B)N\times L\Rightarrow T=L+(g-c)N\ g=\sqrt{n_B^2-n_A^2+c^2} \tag{7}$$

Note that the light beam undergoes total reflection at the interface if $n_B^2-n_A^2+c^2<0$.

Prismatic Structural Bodies Provided on Outdoor Side, Slats Yet to be Rotated

Figure 9:
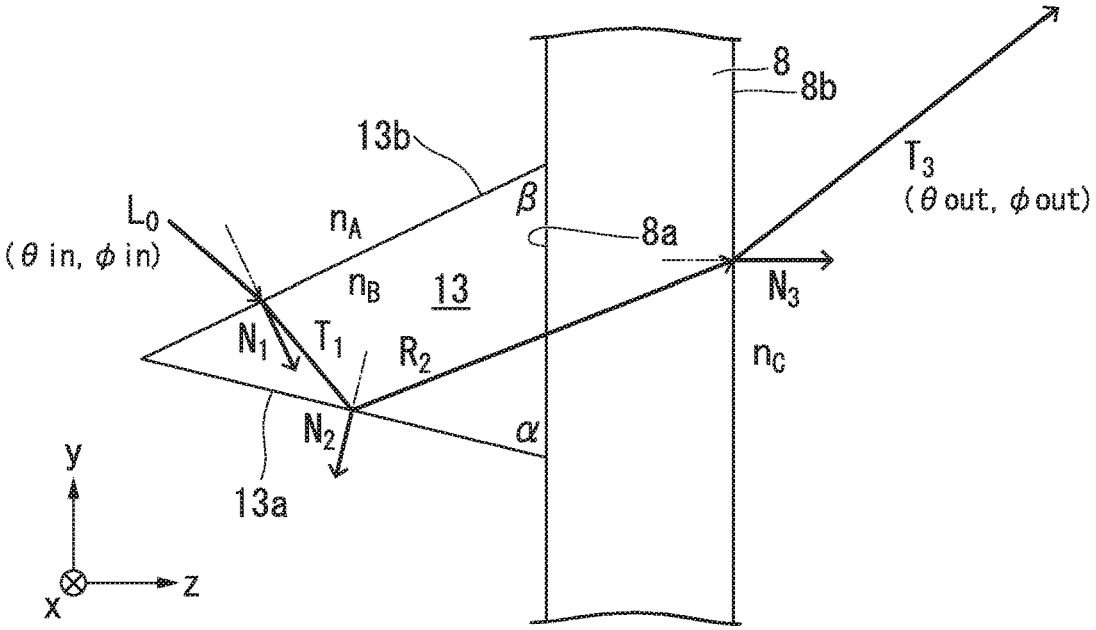
FIG. 9 is a diagram showing an optical path of single-reflection light in an unrotated daylighting slat that has a prismatic structural body on the outdoor side thereof.

FIG. 9 shows an optical path of light that reflects once off the first face 13*a* of the prismatic structural body 13 before exiting the base member 8 in an unrotated daylighting slat.

Light that reflects once off the first face of the prismatic structural body before exiting will be referred to as "single-reflection light" in the following.

L0 is an incident light vector, $T_1$ is a refracted light vector on the second face 13*b*, $R_2$ is a reflected light vector off the first face 13*a*, and $T_3$ is an exiting light vector from the base member 8.

N1 is a normal vector on the second face 13*b*, N2 is a normal vector on the first face 13*a*, and N3 is a normal vector on the second face 8*b* of the base member 8.

Letting α denote an angle between the first face 13*a* of the prismatic structural body 13 and the first face 8*a* of the base member 8, and β denote an angle between the second face 13*b* of the prismatic structural body 13 and the first face 8*a* of the base member 8, it then follows that $0°<\alpha\leq 90°$ and $0°\leq\beta\leq 90°$. If there are provided prismatic structural bodies on the outdoor side, light primarily is incident on the second face 13*b* and reflects off the first face 13*a* before passing through and exiting the base member 8. Therefore, light is preferably more likely to be incident on the second face 13*b* rather than on the first face 13*a*. Thus, it is preferable that $\alpha\geq\beta$. In a design assuming that $n_A=n_C=1$ and $1.49\leq n_B\leq 1.65$, preferred conditions for achieving both reduced glare and enhanced daylighting performance are given by the inequalities, $64°\leq\alpha\leq 90°$ and $42°\leq\beta\leq 90°$.

Figure 10:
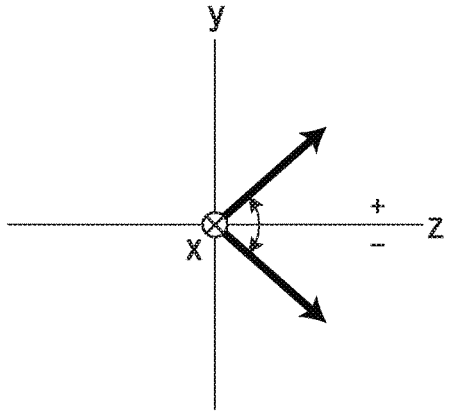
FIG. 10 is a diagram illuminating sign designation for altitude.

In addition, letting θin denote an incident angle of altitude, φin denote an incident angle of orientation, θout denote an emission angle of altitude, and φout denote an emission angle of orientation, these parameters satisfy inequalities, $-90°\leq\theta in\leq 90°$, $-90°\leq\varphi in\leq 90°$, $-90°\leq\theta out\leq 90°$, and $-90°\leq out\leq 90°$. The parameters are expressed in a horizontal coordinate system by taking the y-axis as the zenith. Altitude is, as shown in FIG. 10, positive if it is counterclockwise with respect to a horizontal plane and negative if it is clockwise. Note that viewed from the negative side toward the positive side along the x-axis in the coordinate system, a counterclockwise rotation with respect to a horizontal plane is represented by a positive value, and a clockwise rotation is represented by a negative value. If viewed from the positive side toward the negative side along the x-axis, a clockwise rotation with respect to a horizontal plane is represented by a positive value, and a counterclockwise rotation is represented by a negative value, which is opposite to the case in FIG. 10.

Accordingly, if sunlight is incident from above and reflects toward the room ceiling, it follows that $\theta in<0$ and $\theta out>0$.

Using the reflection equation (6) and the refraction equation (7) above, refracted light vector $T_1$, reflected light vector $R_2$, and exiting light vector $T_3$ are given respectively by Eqs. (8), (9), and (10).

$$T_1=L_0+(g_1-c_1)N_1$$

$$g_1=\sqrt{n_B^2-n_A^2+c_1^2}$$

$$c_1=N_1\cdot L_0 \tag{8}$$

$$R_2=T_1-2c_2N_2$$

$$c_2=N_2\cdot T_1 \tag{9}$$

$$T_3=R_2+(g_3-c_3)N_3$$

$$g_3=\sqrt{n_C^2-n_B^2+c_3^2}$$

$$c_3=N_3\cdot R_2 \tag{10}$$

Eq. (11) is derived from Eqs. (8), (9), and (10).

$$T_3=L_0+(g_1-c_1)N_1-2c_2N_2+(g_3-c_3)N_3 \tag{11}$$

Normal vectors N1, N2, and N3 in Eq. (11) are given respectively by Eqs. (12), (13), and (14).

$$N_1=\begin{pmatrix}0\\ \sin(-\beta)\\ \cos(-\beta)\end{pmatrix} \tag{12}$$

$$N_2=\begin{pmatrix}0\\ \sin(\alpha+\pi)\\ \cos(\alpha+\pi)\end{pmatrix} \tag{13}$$

$$N_3=\begin{pmatrix}0\\ 0\\ 1\end{pmatrix} \tag{14}$$

Prismatic Structural Bodies Provided on Outdoor Side, Slats Rotated

Figure 11:
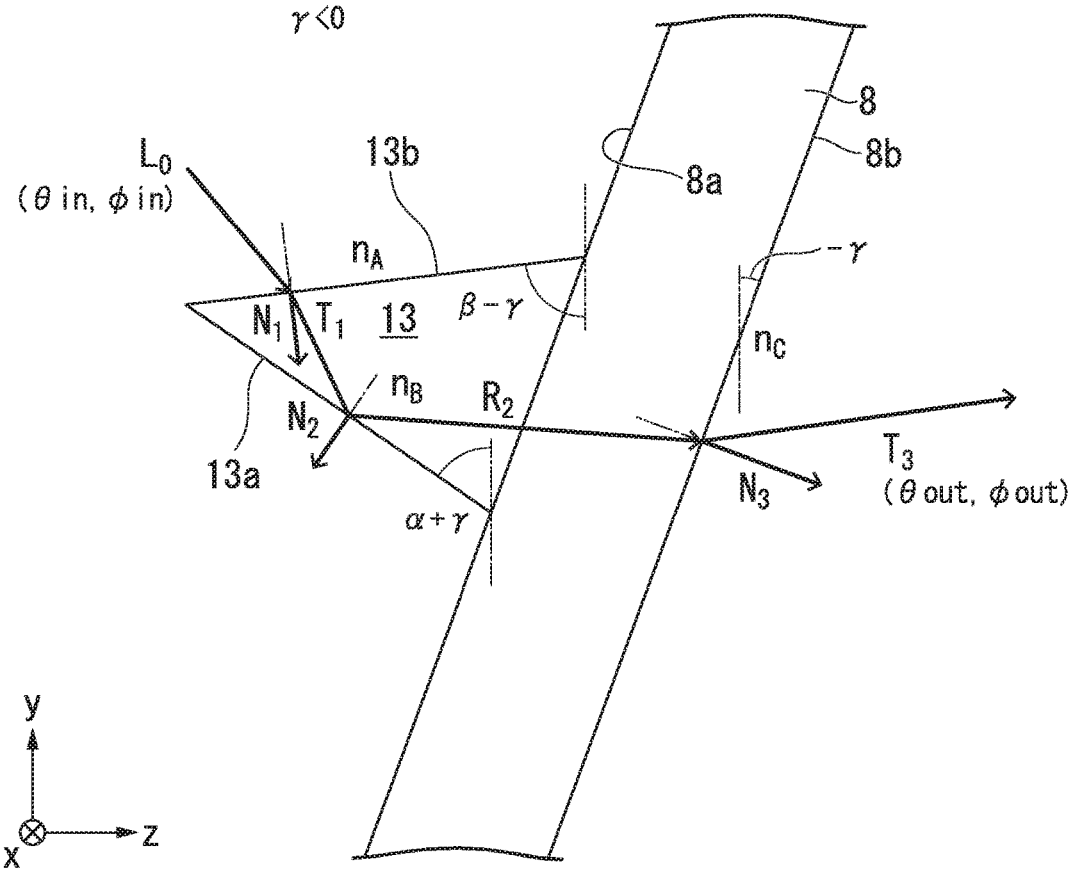
FIG. 11 is a diagram showing an optical path of single-reflection light in the daylighting slat that is now rotated.

FIG. 11 shows an optical path of single-reflection light in a rotated daylighting slat.

Figure 12:
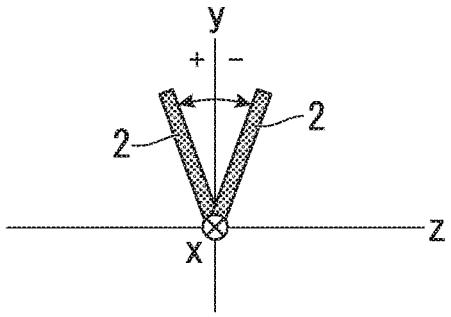
FIG. 12 is a diagram illuminating sign designation for the slat rotation angle.

The slat rotation angle γ is, as shown in FIG. 12, positive if the daylighting slat 2 is rotated counterclockwise and negative if the daylighting slat 2 is rotated clockwise. Accordingly, if the upper end of the daylighting slat 2 is rotated toward the interior of the room, the slat rotation angle γ is negative; if the upper end of the daylighting slat 2 is rotated toward the exterior, the slat rotation angle γ is positive.

The slat rotation angle γ can range from $-90\leq$ to $\leq 90°$.

When the daylighting slat is rotated by the slat rotation angle γ, normal vectors N1, N2, and N3 are given respectively by Eqs. (15), (16), and (17) below.

$$N_1=\begin{pmatrix}0\\ \sin(-\beta+\gamma)\\ \cos(-\beta+\gamma)\end{pmatrix} \tag{15}$$

$$N_2=\begin{pmatrix}0\\ \sin(\alpha+\gamma+\pi)\\ \cos(\alpha+\gamma+\pi)\end{pmatrix} \tag{16}$$

-continued $$N_3 = \begin{pmatrix} 0 \\ \sin\gamma \\ \cos\gamma \end{pmatrix} \tag{17}$$

Expanding Eq. (11) above in terms of y components, one can obtain Eq. (18) below.

$$n_C \sin\theta_{out} = n_A \sin\theta_{in} + (g_1 - c_1)\sin(-\beta+\gamma) - 2c_2 \sin(\alpha+\gamma+\pi) + (g_3 - c_3)\sin\gamma \tag{18}$$

Solving Eq. (18) for θout in combination with the fact that light is emitted horizontally or toward the ceiling when θout is greater than or equal to the offset angle δ, one can obtain Eq. (19) below.

$$\theta_{out} = \sin^{-1}\left\{\frac{n_A}{n_C}\sin\theta_{in} + \frac{g_1 - c_1}{n_C}\sin(\gamma-\beta) + \frac{2c_2}{n_C}\sin(\gamma+\alpha) + \frac{g_3 - c_3}{n_C}\sin\gamma\right\} \equiv f(\theta_{in}, \varphi_{in}, \gamma) \geqq \delta \tag{19}$$

The memory 21 in the control unit 6 contains in advance a correlation, θout=f(θin, φin, γ), in the form of a table or mathematical expression. Accordingly, the central processing unit 20 in the control unit 6 calculates a minimum slat rotation angle γ that satisfies θout≥γ in Eq. (19) on the basis of the correlation stored in the memory 21. The slat rotation angle γ can be numerically determined by incrementing |γ| by 1° starting at γ=0°, regardless of whether γ is positive or negative. Basically, this calculation is done only once upon the installation of the daylighting device, and thereafter, a correlation table for the date and time and the slat rotation angle γ contained in the memory 21 will serve the intended purpose.

Daylighting Slats with Different Structure, Slats Rotated

The following will describe a case where daylighting slats with a different structure are used.

Figure 13:
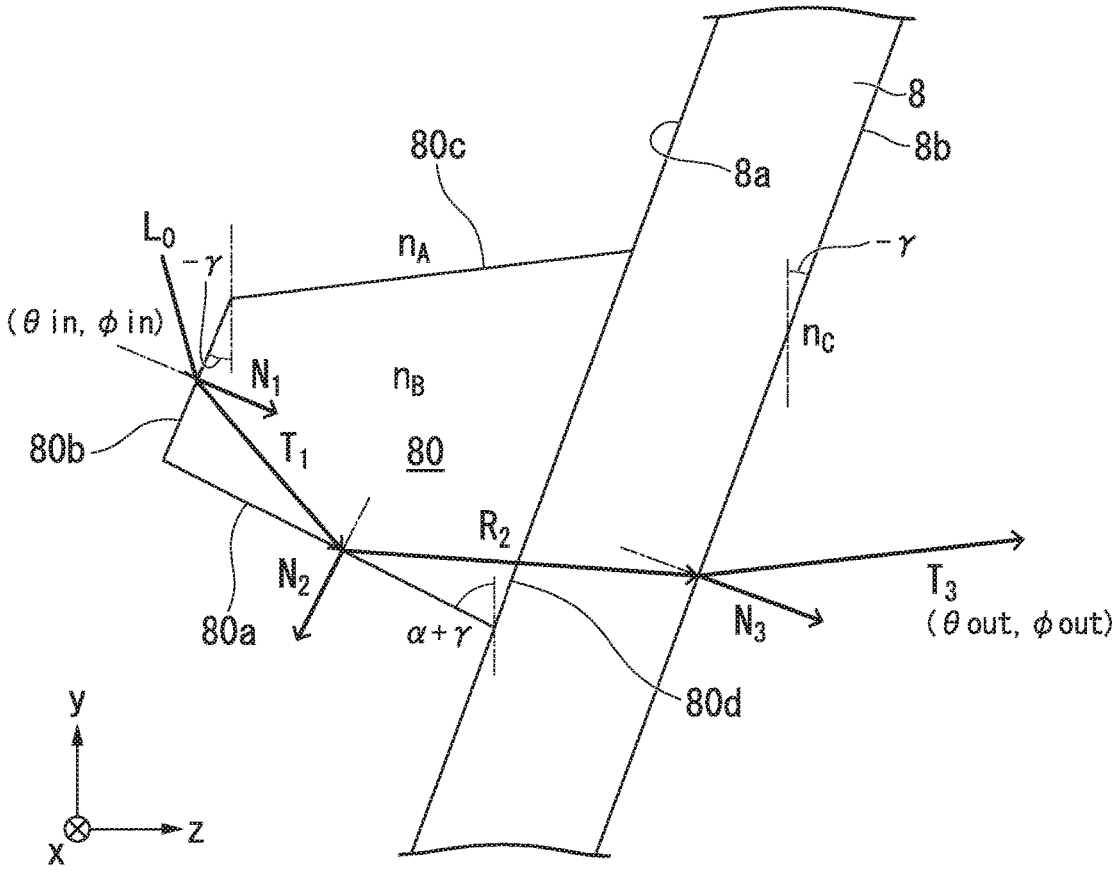
FIG. 13 is a diagram showing an optical path of single-reflection light in a rotated daylighting slat in accordance with a variation example.

FIG. 13 shows an optical path of single-reflection light in a rotated daylighting slat that has a different structure.

This is an example daylighting slat with a prismatic structural body 80 that is quadrilateral in a cross-section taken perpendicular to the length thereof.

The prismatic structural body 80 has: a first face 80*a* serving primarily as a reflection face that reflects off incident light; a second face 80*b* serving primarily as an entrance face on which sunlight is incident; a third face 80*c* that is in contact with the second face 80*b* along a side thereof; and a fourth face 80*d* that is in contact with the first face 8*a* of the base member 8. The second face 80*b* is parallel to the fourth face 80*d*. Since the angle between the first face 8*a* (reference face for the daylighting slats 2) and the second face 80*b* of the base member 8 is the angle θ, this shape of the prismatic structural body 80 is an example where β=0°.

When β has a small value (e.g., when β=0°), light may pass through the daylighting slat without hitting the reflection face if the sun's altitude is low. Therefore, glare reduction and daylighting performance enhancement has a trade-off relationship.

When the daylighting slat is rotated by the slat rotation angle γ, normal vectors N1, N2, and N3 are given respectively by Eqs. (20), (21), and (22) below.

$$N_1 = \begin{pmatrix} 0 \\ \sin\gamma \\ \cos\gamma \end{pmatrix} \tag{20}$$

-continued $$N_2 = \begin{pmatrix} 0 \\ \sin(\alpha+\gamma+\pi) \\ \cos(\alpha+\gamma+\pi) \end{pmatrix} \tag{21}$$

$$N_3 = \begin{pmatrix} 0 \\ \sin\gamma \\ \cos\gamma \end{pmatrix} \tag{22}$$

Expanding Eq. (11) above in terms of y, one can obtain Eq. (23) below.

$$n_C \sin\theta_{out} = n_A \sin\theta_{in} + (g_1 - c_1 + g_3 - c_3)\sin\gamma - 2c_2 \sin(\alpha+\gamma+\pi) \tag{23}$$

Solving Eq. (23) for θout in combination with the fact that light is emitted horizontally or toward the ceiling when θout is greater than or equal to the offset angle δ, one can obtain Eq. (24) below.

$$\theta_{out} = \sin^{-1}\left\{\frac{n_A}{n_C}\sin\theta_{in} + \frac{g_1 - c_1 + g_3 - c_3}{n_C}\sin\gamma + \frac{2c_2}{n_C}\sin(\gamma+\alpha)\right\} \equiv f(\theta_{in}, \varphi_{in}, \gamma) \geqq \delta \tag{24}$$

The memory 21 in the control unit 6 contains in advance a correlation, θout=f(θin, φin, γ), in the form of a table or mathematical expression. Accordingly, the central processing unit 20 in the control unit 6 calculates a minimum slat rotation angle γ that satisfies θout≥δ in Eq. (24) on the basis of the correlation stored in the memory 21. The slat rotation angle γ can be numerically determined by incrementing |γ| by 1° starting at γ=0°, regardless of whether γ is positive or negative. Like the previous example, this calculation is basically done only once upon the installation of the daylighting device, and thereafter, a correlation table for the date and time and the slat rotation angle γ contained in the memory 21 will serve the intended purpose.

A gap portion between adjacent prismatic structural bodies 80 may contain air. Alternatively, the gap portion may be filled with a low-refractive-index material that exhibits a refractive index $n_A$ that is lower than the refractive index $n_B$ of the prismatic structural body 80 as shown in, for example, FIG. 35 which will be described later in detail. In addition, there may be provided a plurality of base members 8 in place of the single base member 8.

Prismatic Structural Bodies Provided on Indoor Side, Slats Rotated

The following will describe a case where daylighting slats with a prismatic structural body 83 on the indoor side thereof are used.

Figure 14:
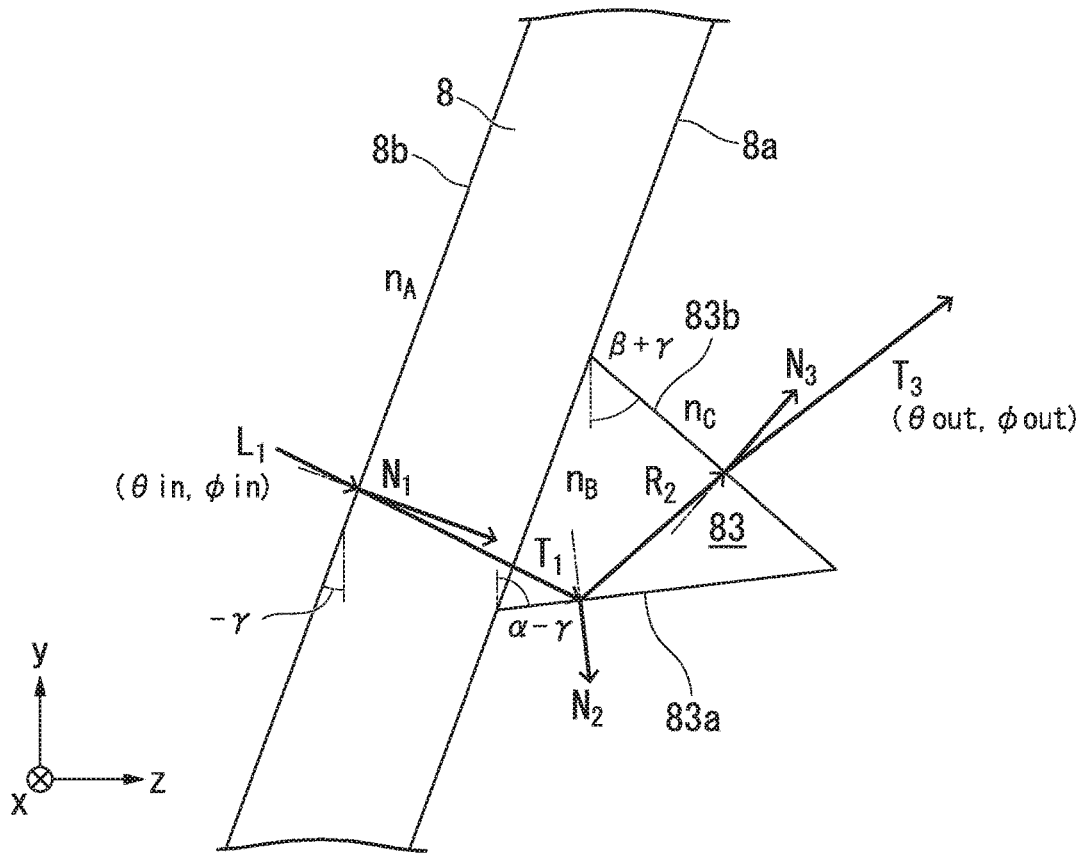
FIG. 14 is a diagram showing an optical path of single-reflection light in a rotated daylighting slat that has a prismatic structural body on the indoor side thereof.

FIG. 14 shows an optical path of single-reflection light in a rotated daylighting slat that includes the prismatic structural body 83 on the indoor side thereof.

Similarly to FIG. 11, this is an example daylighting slat with the prismatic structural body 83 that is triangular in a cross-section taken perpendicular to the length thereof.

Letting α denote an angle between a first face 83*a* of the prismatic structural body 83 and the first face 8*a* of the base member 8, and β denote an angle between a second face 83*b* of the prismatic structural body 83 and the first face 8*a* of the base member 8, it then follows that 0°<α≤90° and 0°≤β≤90°. If there are provided prismatic structural bodies on the indoor side, light primarily passes through the base member, enters the prismatic structural body 83, reflects off the first face 83*a* before exiting through the second face 83*b*.

Therefore, light is preferably more likely to be incident on the first face 83*a* rather than on the second face 83*b*. Thus, it is preferable that $\alpha \leq \beta$. In a design assuming that $n_A = n_C = 1$ and $1.49 \leq n_B \leq 1.65$, the ranges of $\alpha$ and $\beta$ are such that $51° \leq \alpha \leq 83°$ and $33° \leq \beta \leq 90°$, which are preferred conditions for achieving both reduced glare and enhanced daylighting performance.

If the upper end of the daylighting slat is rotated toward the interior of the room, the slat rotation angle $\gamma$ is positive; if the upper end of the daylighting slat is rotated toward the exterior, the slat rotation angle $\gamma$ is negative.

When the daylighting slat is rotated by the slat rotation angle $\gamma$, normal vectors N1, N2, and N3 are given respectively by Eqs. (25), (26), and (27) below.

$$N_1 = \begin{pmatrix} 0 \\ \sin\gamma \\ \cos\gamma \end{pmatrix} \tag{25}$$

$$N_2 = \begin{pmatrix} 0 \\ \sin(-\alpha+\gamma) \\ \cos(-\alpha+\gamma) \end{pmatrix} \tag{26}$$

$$N_3 = \begin{pmatrix} 0 \\ \sin(\beta+\gamma) \\ \cos(\beta+\gamma) \end{pmatrix} \tag{27}$$

Expanding Eq. (11) above in terms of y, one can obtain Eq. (28) below.

$$n_C \sin\theta_{out} = n_A \sin\theta_{in} + (g_1 - c_1)\sin\gamma - 2c_2 \sin(-\alpha+\gamma) + (g_3 - c_3)\sin(\beta+\gamma) \tag{28}$$

Solving Eq. (28) for $\theta$out in combination with the fact that light is emitted horizontally or toward the ceiling when $\theta$out is greater than or equal to the offset angle $\delta$, one can obtain Eq. (29) below.

$$\theta_{out} = \sin^{-1}\left\{\frac{n_A}{n_C}\sin\theta_{in} + \frac{g_1 - c_1}{n_C}\sin\gamma - \frac{2c_2}{n_C}\sin(\gamma-\alpha) + \frac{g_3 - c_3}{n_C}\sin(\gamma+\beta)\right\} \equiv f(\theta_{in}, \varphi_{in}, \gamma) \geqq \delta \tag{29}$$

The memory 21 in the control unit 6 contains in advance a correlation, $\theta$out=f($\theta$in, $\varphi$in, $\gamma$), in the form of a table or mathematical expression. Accordingly, the central processing unit 20 in the control unit 6 calculates a minimum slat rotation angle $\gamma$ that satisfies $\theta$out$\geq\delta$ in Eq. (29) on the basis of the correlation stored in the memory 21. The slat rotation angle $\gamma$ can be numerically determined by incrementing $|\gamma|$ by 1° starting at $\gamma$=0°, regardless of whether $\gamma$ is positive or negative.

As described so far, although the position of the sun changes over the course of a year or a day, the daylighting device 1 in accordance with the present embodiment is capable of stably guiding direct light deep into the room while restraining glare, thereby achieving efficient daylighting.

As mentioned earlier, the daylighting device 1 in accordance with the present embodiment has the advantage of decreasing the incident angle of altitude with respect to a normal direction K of the first face 8*a* of the base member 8 (first advantage) and the advantage of decreasing the emission angle of altitude with respect to the horizontal plane H (second advantage), if the daylighting slats 2 are rotated, for example, in response to an increased altitude of the sun (increased incident angle of altitude of light on the horizontal plane). The combination of these two advantages brings the direction of emission of light closer to a horizontal direction, thereby guiding direct light deep into the room.

Figure 15A:
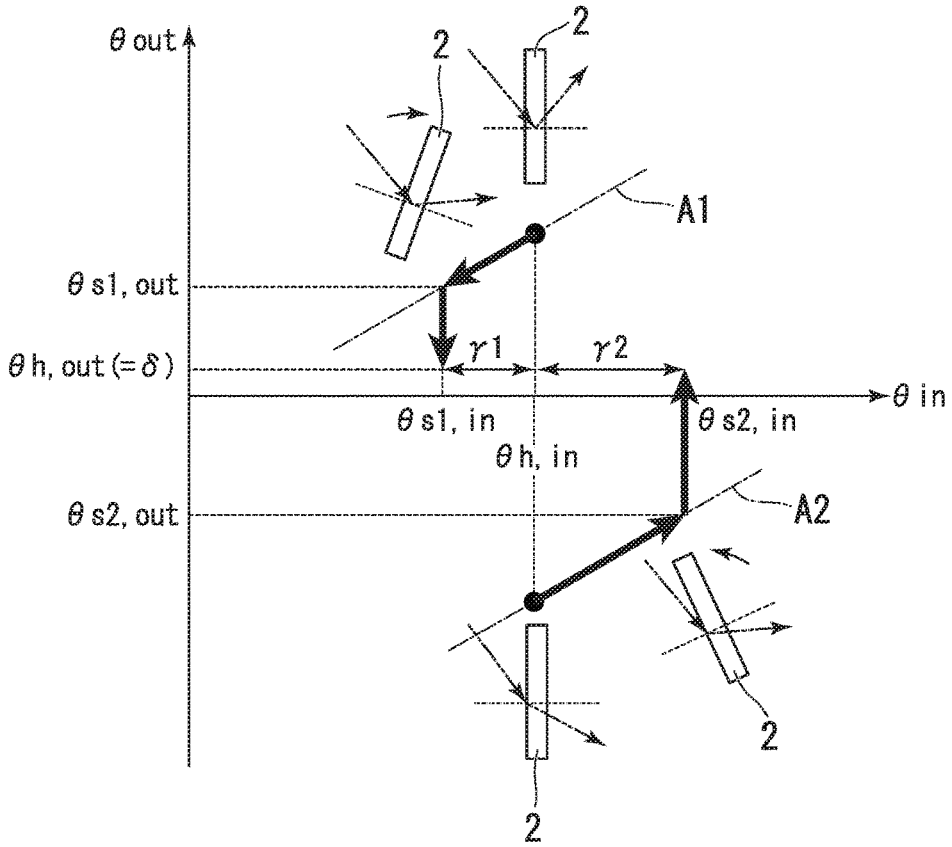
FIG. 15A is a first diagram representing effects of rotation of a daylighting slat.

The direction of emission of light can be brought closer to a horizontal direction by rotating the daylighting slat 2 in such a direction as to tilt the upper part of the daylighting slat 2 toward the interior of the room (clockwise in FIG. 15A) when $\Delta\theta$out/$\Delta\theta$in>0 and $\theta$out>0 as indicated by a straight line denoted by reference symbol A1 in FIG. 15A. More specifically, the rotation of the daylighting slat 2 by an angle $\gamma$1 (slat rotation angle $\gamma$=$\gamma$1) results in achieving the advantage of decreasing the incident angle of altitude with respect to the normal direction K of the base member surface by the angle $|\gamma 1|$ over the incident angle of altitude obtained when the daylighting slat 2 is not inclined (slat rotation angle $\gamma$=0) and the advantage of decreasing the emission angle of altitude with respect to the normal direction K of the base member surface by the angle $|\gamma 1|$ over the emission angle of altitude obtained when the daylighting slat 2 is not inclined (slat rotation angle $\gamma$=0). The combination of these two advantages brings the emission angle of altitude with respect to the horizontal plane H closer to a horizontal direction.

If the daylighting slats 2 are flat like a plate in a window shade using ladder cords as in the present embodiment, the daylighting slats 2 can be often rotated only in such a direction as to tilt the upper parts of the daylighting slats 2 toward the interior of the room. Therefore, it is preferable that $\Delta\theta$out/$\Delta\theta$in>0 and $\theta$out>0.

Next, the direction of emission of light can be brought closer to a horizontal direction by rotating the daylighting slat 2 in such a direction as to tilt the upper part of the daylighting slat 2 toward the exterior of the room (counterclockwise in FIG. 15A) when $\Delta\theta$out/$\Delta\theta$in>0 and $\theta$out<0 as indicated by a straight line denoted by reference symbol A2 in FIG. 15A. More specifically, the rotation of the daylighting slat 2 by an angle $\gamma$2 (slat rotation angle $\gamma$=$\gamma$2) results in achieving the advantage of increasing the incident angle of altitude with respect to the normal direction K of the base member surface by the angle $\gamma$2 over the incident angle of altitude obtained when the daylighting slat 2 is not inclined (slat rotation angle $\gamma$=0) and the advantage of increasing the emission angle of altitude with respect to the normal direction K of the base member surface by the angle $\gamma$2 over the emission angle of altitude obtained when the daylighting slat 2 is not inclined (slat rotation angle $\gamma$=0). The combination of these two advantages brings the emission angle of altitude with respect to the horizontal plane H closer to a horizontal direction.

As described above, the daylighting slats 2 can be often inclined only in either one of two directions if the daylighting slats 2 are shaped flat like a plate. In contrast, the daylighting slats 2 can be rotated in both directions (both toward the interior and toward the exterior) if the daylighting slats 2 are shaped like the letter Y or T in a cross-section taken perpendicular to the length thereof. The latter configuration minimizes the slat rotation angle both when $\Delta\theta$out/$\Delta\theta$in>0 and $\theta$out>0 and when $\Delta\theta$out/$\Delta\theta$in>0 and $\theta$out<0.

Figure 15B:
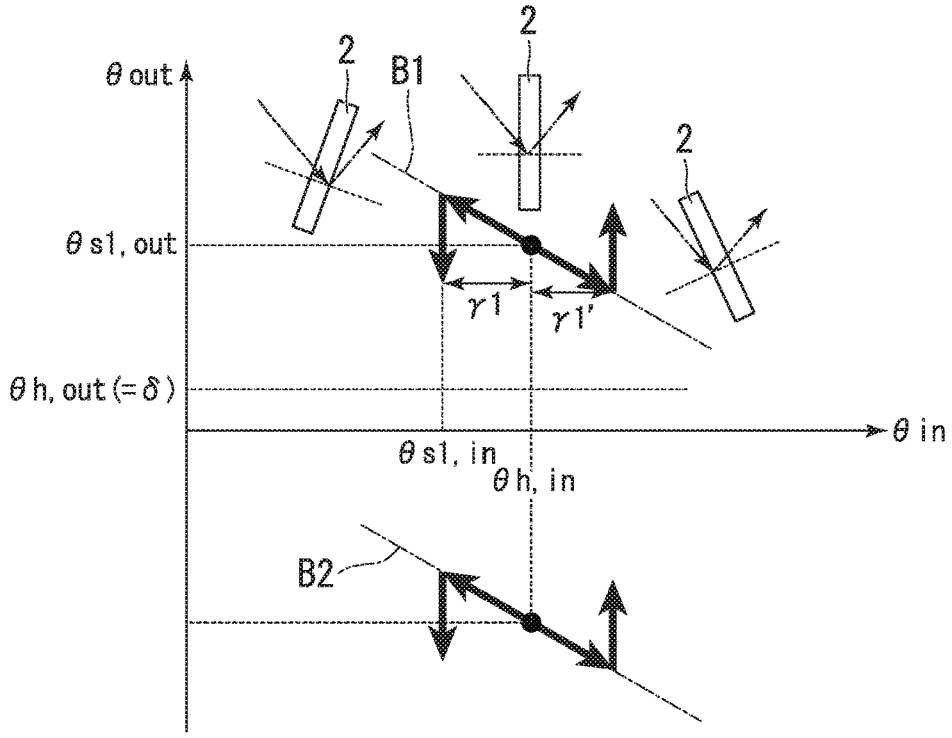
FIG. 15B is a second diagram representing effects of rotation of a daylighting slat.

If $\Delta\theta$out/$\Delta\theta$in <0 as indicated by straight lines denoted by reference symbols B1 and B2 in FIG. 15B, the first and second advantages cancel out. Therefore, it is difficult to bring the direction of emission of light closer to a horizontal direction, in no matter which direction the daylighting slat 2 is rotated. There exists a possibility of decreasing the emission angle of altitude, however, only either if the absolute value of the inclination, $\Delta\theta out/\Delta\theta in$, is sufficiently large or if the inclination, $\Delta\theta out/\Delta\theta in$, is close to 0. If $\Delta\theta out/\Delta\theta in=-1$, there is no advantage at all in rotating the slats.

Figure 16:
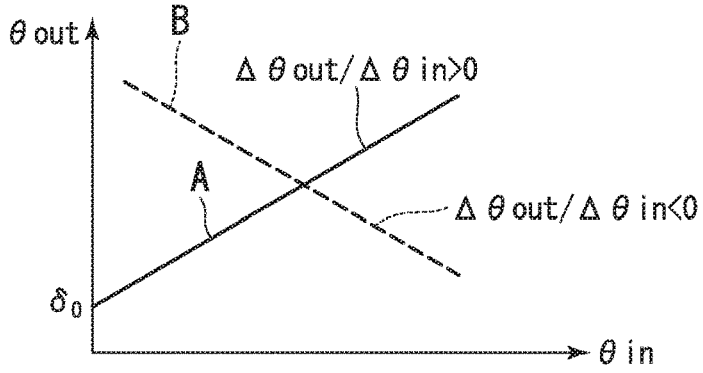
FIG. 16 is a diagram representing a relationship between angle of incidence and angle of emergence.

The discussion above gives a conclusion that it is preferable that $\Delta\theta out/\Delta\theta in>0$ (indicated by the straight line denoted by reference symbol A) rather than that $\Delta\theta out/\Delta\theta in<0$ (indicated by the straight line denoted by reference symbol B) as shown in FIG. 16, in order to decrease the emission angle of altitude $\theta out$, in other words, to bring the direction of emission of light closer to a horizontal direction.

If $\theta in=0$ when $\Delta\theta out/\Delta\theta in>0$ (indicated by the straight line denoted by reference symbol A) as shown in FIG. 16, it then follows that $\theta out=\delta 0$ (reference offset angle). To illuminate a wide area all the way from the proximity of the window of the room to the deep part of the room, the offset angle is preferably from 0° to 5° inclusive. For these reasons, the prismatic structural body is preferably shaped so that when the daylighting slats are in a reference position with a slat rotation angle $\gamma 0$ (in the present embodiment, $\gamma 0=0$ if the prismatic structural bodies are disposed on the outdoor side of the slats, and $\gamma 0=-20°$ if the prismatic structural bodies are disposed on the indoor side of the slats), there exists at least in a part thereof such a combination of the angles $\alpha$ and $\beta$ that $0<\alpha\leq 90°$, $0°\leq\beta\leq 90°$, and $0°\leq\delta 0\leq 5°$ where $\delta 0$ (reference offset angle) refers to $\theta out$ in the case of $\theta in=0°$. In other words, it is only required that the prismatic structural body have, on at least two corners of the faces thereof (of the polygonal prism), a combination of the angles $\alpha$ and $\beta$ that satisfies these conditions. Therefore, the prismatic structural body is not necessarily shaped as a triangular prism and may be shaped, for example, as any polygonal (non-triangular) prism.

As an example, if the offset angle equals 0°, that is, if light is emitted horizontally (parallel to the floor surface), the light will hit a wall opposite the window and hardly brightens up the ceiling or the center of the room. Hence, the offset angle is set to approximately several degrees in accordance with the size of the room so that the light can travel obliquely at approximately several degrees upward toward the ceiling, which illuminates a wide area all the way from the proximity of the window of the room to the deep part of the room.

Specifically, assume that the room have a ceiling with a height H (meters). If the daylighting device is installed higher than the floor by $H_0$ (meters), the lower end of the daylighting device is separated from the ceiling by a distance $H-H_0$ (meters). Under these conditions, the light emitted from the lower end of the daylighting device at offset angle $\delta$ hits a part of the ceiling from the window to a depth of $(H-H_0)/\tan\delta$ (meters). The offset angle $\delta$ is preferably determined so that this distance is roughly equal to the depth D of the room. In other words, the offset angle $\delta$ is preferably reduced to a minimum as far as the inequality, $(H-H_0)/\tan\delta\leq D$, holds.

For example, when H=2.7 meters and $H_0$=2.0 meters, D=15 meters if $\delta=2.7°$, D=8 meters if $\delta=5°$, and D=4 meters if $\delta=10°$. One would rarely need a daylighting device in a room with a depth of 4 meters. Accordingly, assuming that the daylighting device be installed in a room with an approximate depth of at least 8 meters, the offset angle $\delta$ would safely be approximately no more than 5°.

If $\theta in>0°$, adjusting the tilt of the daylighting slats closer to the tilt thereof in the reference position than to the tilt thereof for horizontal emission ($\delta=0°$) will make $\gamma>0$, which adjusts Bout so as to restrain glaring by guiding light toward the ceiling. However, if the daylighting slats have a mechanism that prohibits the daylighting slats from being rotated toward the exterior of the room and $\theta in=0°$, light cannot be emitted toward the ceiling no matter how the daylighting slats are rotated. In such a case, $\delta 0$ needs to be made greater than 0 in designing the daylighting slats.

Figure 17A:
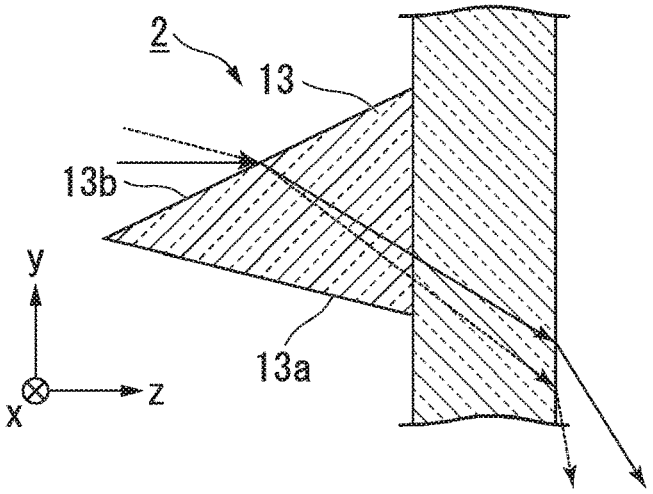
FIG. 17A is a first diagram representing light following different optical paths depending on the number of reflections that the light undergo in a daylighting section.

Assume, next, that sunlight L, incident on the first face 13*a* of the prismatic structural body 13, be only refracted and not reflected before exiting the daylighting slat 2, as shown in FIG. 17A.

In other words, if light undergoes no reflection at all in the prismatic structural body 13, $\Delta\theta out/\Delta\theta in<0$ because the emission angle of altitude $\theta out$ decreases with an increase in the incident angle of altitude $\theta in$.

Figure 17B:
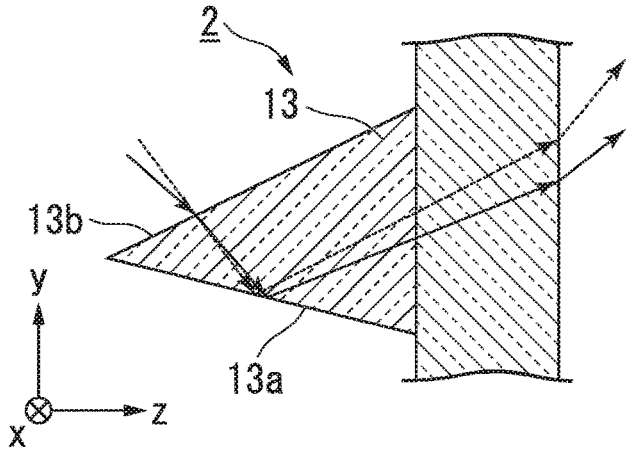
FIG. 17B is a second diagram representing light following different optical paths depending on the number of reflections that the light undergo in a daylighting section.
Figure 17C:
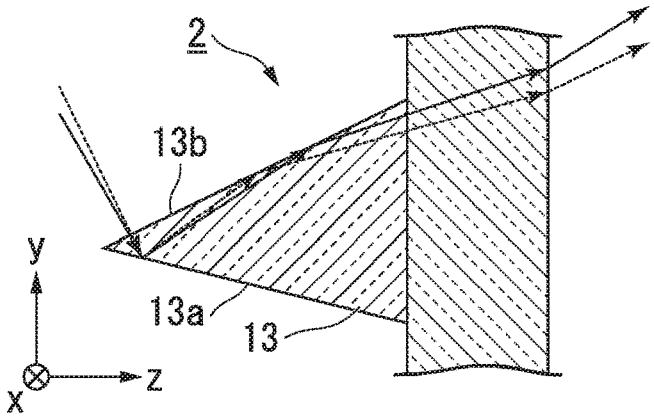
FIG. 17C is a third diagram representing light following different optical paths depending on the number of reflections that the light undergo in a daylighting section.

Meanwhile, if sunlight L, incident to the prismatic structural body 13, undergoes an even number of reflections (twice in this example) before exiting the daylighting slat 2, as shown in FIG. 17C, $\Delta\theta out/\Delta\theta in<0$ because the emission angle of altitude $\theta out$ decreases with an increase in the incident angle of altitude Gin.

Meanwhile, sunlight L, incident to the prismatic structural body 13, undergoes an odd number of reflections (once in this example) before exiting the daylighting slat, as shown in FIG. 17B, $\Delta\theta out/\Delta\theta in>0$ because the emission angle of altitude Bout increases with an increase in the incident angle of altitude $\theta in$.

Therefore, the prismatic structural body 13 is preferably designed to satisfy the following conditions: (1) the prismatic structural body 13 has a fine structure, (2) the prismatic structural body 13 provides a light path along which light undergoes an odd number of reflections, (3) the light having undergone an odd number of reflections has a greater intensity than does the light having undergone an even number of reflections for any possible angle of incidence of light and slat rotation angle, and (4) (2) and (3) hold true in the range of $\theta out>0$.

The inventors of the present invention conducted simulations on the emission angle of altitude of light for various altitudes and bearings (orientations) of the sun. Results of the simulations will be described in reference to FIGS. 18 to 26.

As simulation conditions, daylighting slats were used that had a prismatic structural body resembling a triangular prism, and its refractive index was 1.65. The refractive index was preferably in the range of approximately 1.49 to 1.65.

The prismatic structural body had a bottom taper angle $\alpha$ of 76° and a top taper angle $\beta$ of 64°.

Each daylighting slat with a prismatic structural body on the outdoor side thereof was designed so that the daylighting slat, when in the reference position with $(\theta in, \varphi in)=(0, 0)$ ($\gamma 0=0°$), emitted light 5° upward off a horizontal direction ($\delta 0=5°$). In this manner, although the angle of emergence was 5° when the daylighting slat was in the reference position, the target angle of emergence for all possible positions of the sun was 0° ($\delta=0°$). The prismatic structural body had a bottom taper angle $\alpha$ of 76° and a top taper angle $\beta$ of 64° ($(\alpha, \beta)=(76, 64)$).

Each daylighting slat with a prismatic structural body on the indoor side thereof was designed so that the daylighting slat, when in the reference position with $(\theta in, \varphi in)=(0, 0)$ ($\gamma 0=-20°$), emitted light 5° upward off a horizontal direction ($\delta 0=5°$). The prismatic structural body had a bottom taper angle $\alpha$ of 62° and a top taper angle $\theta$ of 69° ($(\alpha, \beta)=(62, 69)$).

Results of the simulation on the daylighting slats with a prismatic structural body on the outdoor side thereof are shown in FIGS. 18 to 23.

Figure 18:
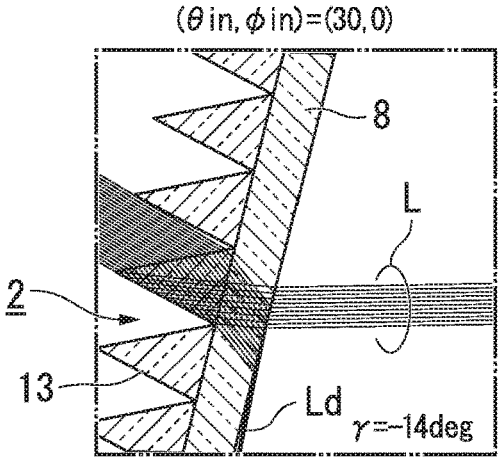
FIG. 18 is an illustration of simulation of exiting light for various altitudes and bearings of the sun.

It is appreciated from FIG. 18 that if the slat rotation angle $\gamma=-14°$ under the conditions, $(\theta in, \varphi in)=(30, 0)$, light L is emitted in a substantially horizontal direction. FIG. 18 shows some light Ld being emitted obliquely downward. However, unlike conventional examples, light Ld changes its angle upon hitting one of the taper surfaces of the prismatic structural body. Therefore, light can be bent downward right under the window (e.g., within 1.5 meters from the window) so as to prevent desk workers in the room from feeling glare, by bending light to travel in the direction below an extension of the incident direction. In contrast, a conventional example has quite a fraction of light passing through the prismatic structural body straightly without being deflected, which can be a cause for glaring light.

Figure 19:
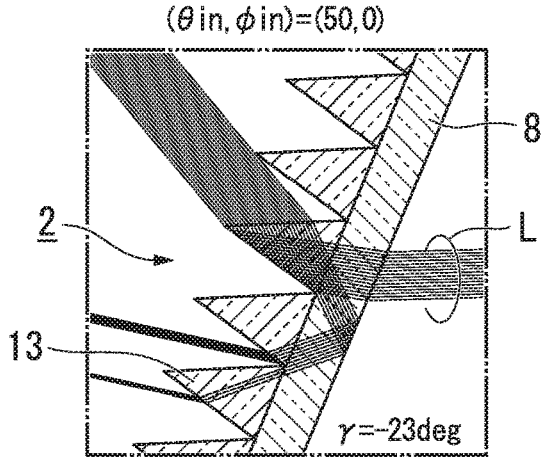
FIG. 19 is an illustration of simulation of exiting light for various altitudes and bearings of the sun.

It is appreciated from FIG. 19 that if the slat rotation angle $\gamma=-23°$ under the conditions, $(\theta in, \varphi in)=(50, 0)$, light L is emitted in a substantially horizontal direction.

Figure 20:
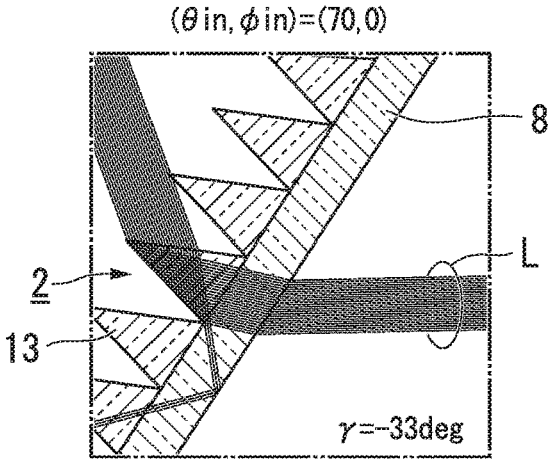
FIG. 20 is an illustration of simulation of exiting light for various altitudes and bearings of the sun.

It is appreciated from FIG. 20 that if the slat rotation angle $\gamma=-33°$ under the conditions, $(\theta in, \varphi in)=(70, 0)$, light L is emitted in a substantially horizontal direction.

Figure 21:
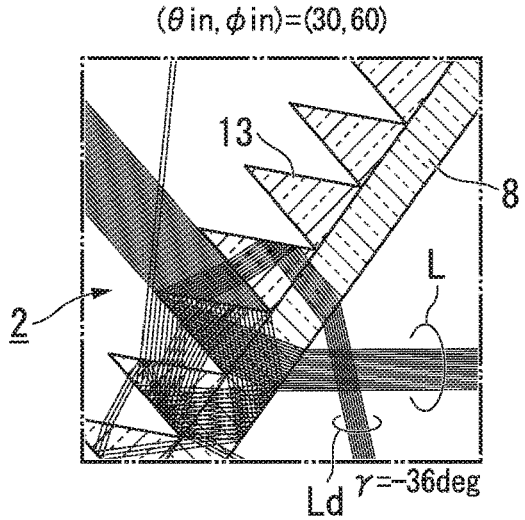
FIG. 21 is an illustration of simulation of exiting light for various altitudes and bearings of the sun.

It is appreciated from FIG. 21 that if the slat rotation angle $\gamma=-36°$ under the conditions, $(\theta in, \varphi in)=(30, 60)$, light L is emitted in a substantially horizontal direction.

Figure 22:
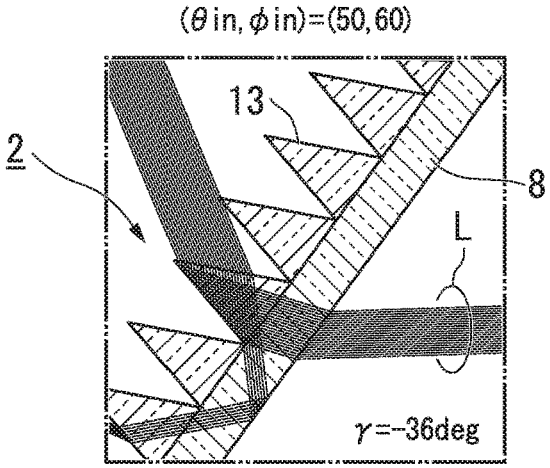
FIG. 22 is an illustration of simulation of exiting light for various altitudes and bearings of the sun.

It is appreciated from FIG. 22 that if the slat rotation angle $\gamma=-36°$ under the conditions, $(\theta in, \varphi in)=(50, 60)$, light L is emitted in a substantially horizontal direction.

Figure 23:
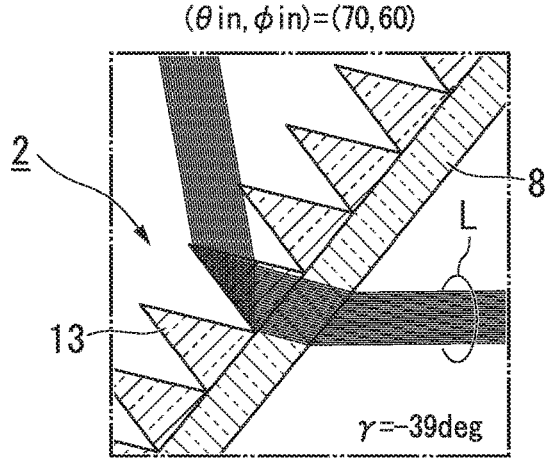
FIG. 23 is an illustration of simulation of exiting light for various altitudes and bearings of the sun.

It is appreciated from FIG. 23 that if the slat rotation angle $\gamma=-39°$ under the conditions, $(\theta in, \varphi in)=(70, 60)$, light L is emitted in a substantially horizontal direction.

Figure 24:
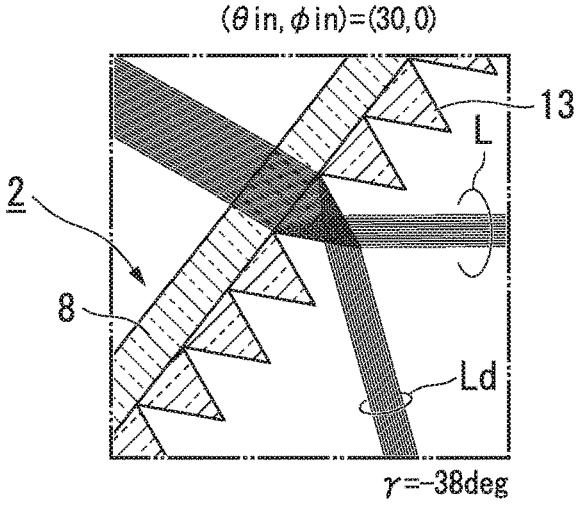
FIG. 24 is an illustration of simulation of exiting light for various altitudes and bearings of the sun.
Figure 25:
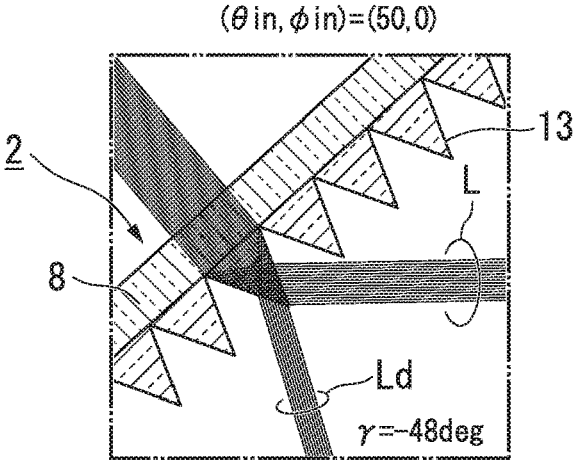
FIG. 25 is an illustration of simulation of exiting light for various altitudes and bearings of the sun.
Figure 26:
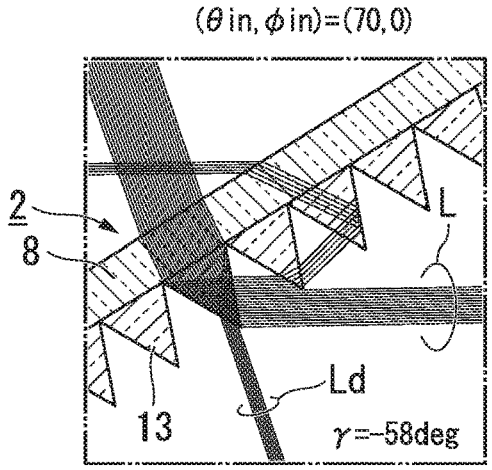
FIG. 26 is an illustration of simulation of exiting light for various altitudes and bearings of the sun.

Results of the simulation on the daylighting slats with a prismatic structural body on the indoor side thereof are shown in FIGS. 24 to 26.

It is appreciated from FIG. 24 that if the slat rotation angle $\gamma=-38°$ under the conditions, $(\theta in, \varphi in)=(30, 0)$, light L is emitted in a substantially horizontal direction.

It is appreciated from FIG. 25 that if the slat rotation angle $\gamma=-48°$ under the conditions, $(\theta in, \varphi in)=(50, 0)$, light L is emitted in a substantially horizontal direction.

It is appreciated from FIG. 26 that if the slat rotation angle $\gamma=-58°$ under the conditions, $(\theta in, \varphi in)=(70, 0)$, light L is emitted in a substantially horizontal direction.

Figure 27:
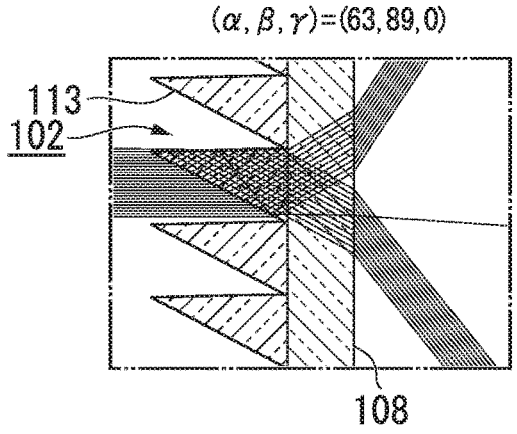
FIG. 27 is an illustration of simulation of exiting light in a daylighting slat in accordance with a comparative example.
Figure 28:
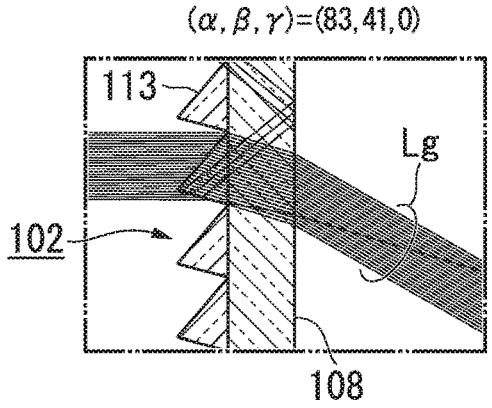
FIG. 28 is an illustration of simulation of exiting light in a daylighting slat in accordance with a comparative example.

Meanwhile, results of the simulation on daylighting slats 102 with a prismatic structural body 113 on the outdoor side thereof are shown in FIGS. 27 and 28. The daylighting slats 102, as comparative examples, satisfied neither of the angle conditions, $64°\leq\alpha\leq90°$ and $42°\leq\beta\leq90°$.

It is appreciated from FIG. 27 that if the slat rotation angle $\gamma=0°$ under the conditions, $(\alpha, \varphi=(63, 89)$, there is little light emitted in a substantially horizontal direction.

It is appreciated from FIG. 28 that if the slat rotation angle $\gamma=0°$ under the conditions, $(\alpha, \beta)=(83, 41)$, it then follows that $\theta out>-30$, and there occurs glaring light Lg.

Figure 29:
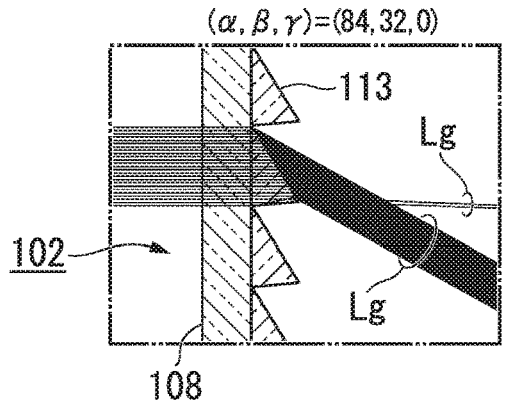
FIG. 29 is an illustration of simulation of exiting light in a daylighting slat in accordance with a comparative example.
Figure 30:
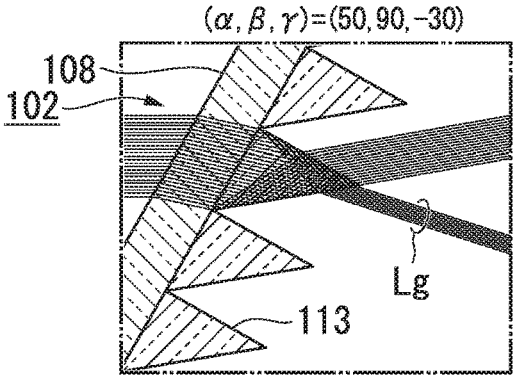
FIG. 30 is an illustration of simulation of exiting light in a daylighting slat in accordance with a comparative example.

Results of the simulation on other daylighting slats 102 with a prismatic structural body 113 on the indoor side thereof are shown in FIGS. 29 and 30. These daylighting slats 102, as comparative examples, satisfied neither of the angle conditions, $51°\leq\alpha\leq83°$ and $33°\leq\beta\leq90°$.

It is appreciated from FIG. 29 that if the slat rotation angle $\gamma=0°$ under the conditions, $(\alpha, \beta)=(84, 32)$, there occurs such light that $\theta out<0$ and $\beta out>-30$, which causes glaring light Lg.

It is appreciated from FIG. 30 that if the slat rotation angle $\gamma=30°$ under the conditions, $(\alpha, \beta)=(50, 90)$, there occurs such light that $\theta out>-30$, which causes glaring light Lg.

From the description so far, it is appreciated that both the daylighting slats with a prismatic structural body on the outdoor side thereof and those with a prismatic structural body on the indoor side thereof can, regardless of how the sun's altitude and bearing changes, emit light in a substantially horizontal direction and hence restrain glare if the prismatic structural bodies are suitably designed and the slat rotation angle $\gamma$ of the daylighting slats is suitably adjusted.

Variation Examples of Daylighting Slats

In the embodiment above, each daylighting slat 2, as an example, includes a daylighting section 9 including prismatic structural bodies integrated with the base member 8. This is merely illustrative, and daylighting slats may take various alternative structures.

Daylighting Slat: First Variation Example

Figure 31:
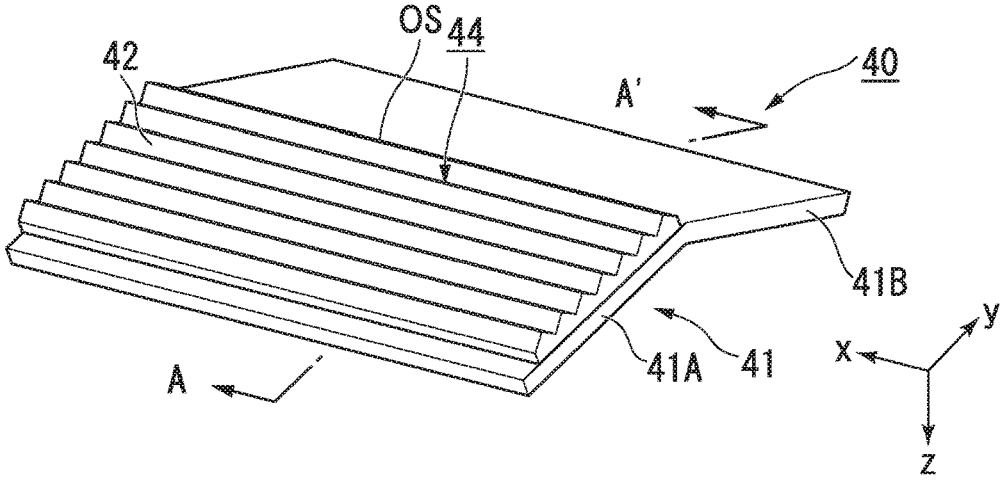
FIG. 31 is a perspective view of a daylighting slat in accordance with a first variation example.
Figure 32:
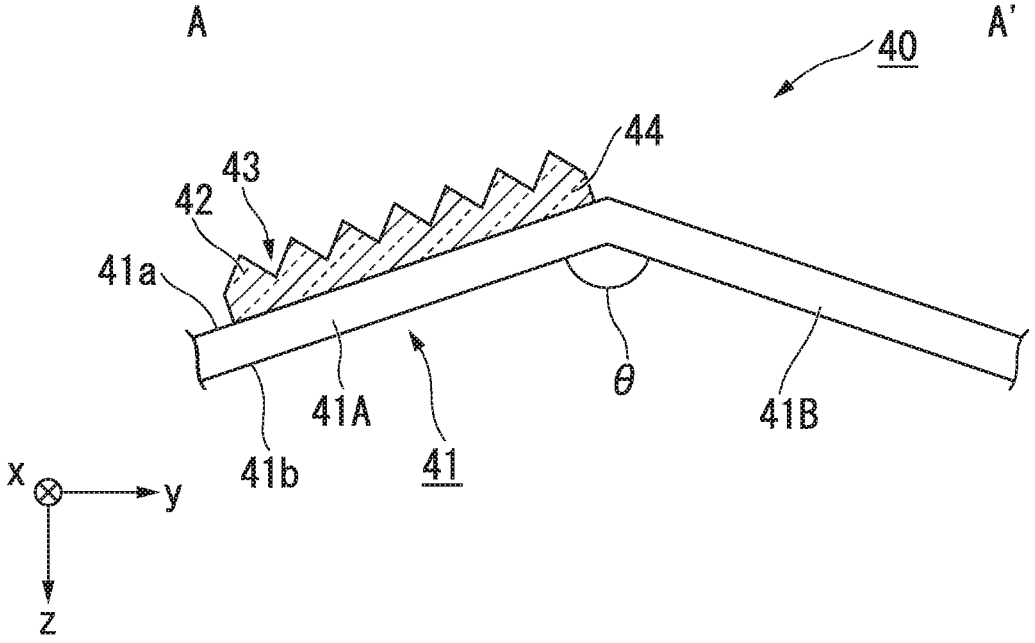
FIG. 32 is a cross-sectional view of the daylighting slat in accordance with the first variation example.

Referring to FIGS. 31 and 32, each daylighting slat 40 in accordance with a first variation example includes a base member 41 and a daylighting section 44. The daylighting section 44 includes prismatic structural bodies 42 that are formed separately from the base member 41. The base member 41 has a shape bent along a bending line OS that is parallel to its length. This shape enables the daylighting section 44 to be controlled to be in a posture closer to an upright position. Privacy is hence better protected when the daylighting slats 40 are inclined in accordance with an increase in the sun's altitude. The base member 41 has a first area 41A and a second areas 41B separated by the bending line OS. The daylighting section 44 is provided in the first area 41A, and no daylighting section 44 is provided in the second area 41B. The second area 41B of the base member 41 has a light-absorbing property. This structure alleviates glare when the daylighting slats 40 are rotated. The second area 41B of the base member 41 may be such that the portion of the base member that makes up the second area 41B inherently has a light-absorbing property. Alternatively, the second area 41B may be given a light-absorbing property, for example, by a colored layer disposed on a surface of the second area 41B.

The first area 41A and the second area 41B of the base member 41 make an angle $\theta$ that is specified in a suitable manner in accordance with the shape of the prismatic structural bodies 42 provided in the first area 41A. The base member 41 may be curved in a cross-section perpendicular to the length of the base member 41 and hence have a curved face. This structure alleviates coloring of the daylighting section caused by dispersion of light. If the entrance face or the exit face is curved instead of the reflection face being curved, the variation of the angle of emergence of light can be reduced.

The base member 41 is made of a transparent resin such as a thermoplastic polymer, a thermosetting resin, or a photopolymerizable resin. The transparent resin may be made primarily of an acrylic-based polymer, an olefins-based polymer, a vinyl-based polymer, a cellulose-based polymer, an amide-based polymer, a fluorine-based polymer, a urethane-based polymer, a silicone-based polymer, or an imide-based polymer. Suitably used among these examples are polymethyl methacrylate resin (PMMA), triacetyl cellulose (TAC), polyethylene terephthalate (PET), cycloolefin polymer (COP), polycarbonate (PC), polyethylene naphthalate (PEN), polyether sulfone (PES), and polyimide (PI). The base member 41 preferably has a total light transmittance of 90% or greater when measured as specified in JIS K7361-1, which gives sufficient transparency.

The prismatic structural bodies 42 are structured and shaped as described in the first embodiment.

Figure 33:
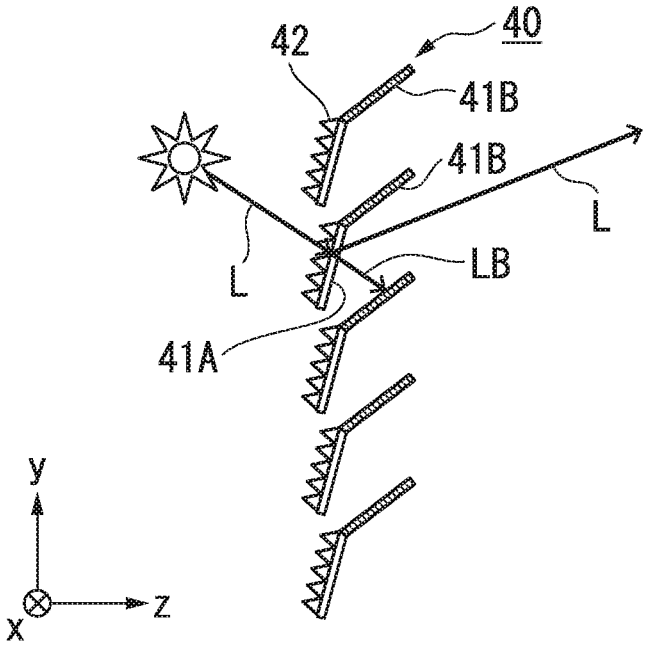
FIG. 33 is an illustration of effects of the daylighting slat in accordance with the first variation example.

The daylighting slats 40 in accordance with the first variation example can achieve efficient daylighting while restraining glare. When the sun's altitude is low, light LB is readily produced that is emitted obliquely downward after traveling through the prismatic structural bodies 42 of the daylighting slat 40 as shown in FIG. 33. In the configuration of the first variation example, however, the second area 41B absorbs light LB that has traveled through the first area 41A of the base member 41 before it can leave the daylighting device obliquely downward. The configuration hence restrains glare.

Daylighting Slat: Second Variation Example

Figure 34:
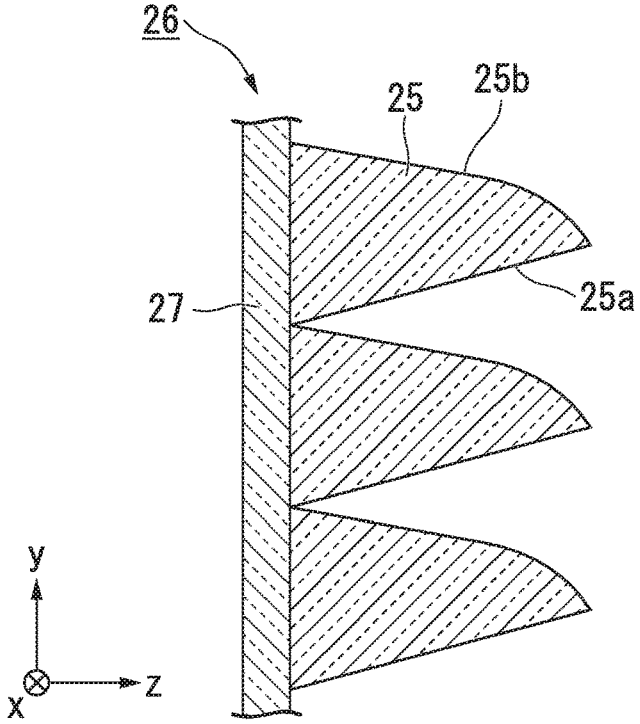
FIG. 34 is a cross-sectional view of a daylighting slat in accordance with a second variation example.

Referring to FIG. 34, each daylighting slat 26 in accordance with a second variation example includes a base member 27 and prismatic structural bodies 25 formed on the base member 27. Each prismatic structural body 25 has a first face 25*a* and a second face 25*b*. The first face 25*a*, serving primarily as a reflection face, is a plane. The second face 25*b*, serving primarily as an entrance face, is curved.

The daylighting slats 26 in accordance with the second variation example, if the slat rotation angle γ of the daylighting slats is adjusted in a suitable manner, can also achieve efficient daylighting while restraining glare. Furthermore, since the second face 25*b*, serving as an entrance face for light, is curved, the daylighting slat 26 restrains color break-up caused by wavelength dispersion.

Daylighting Slat: Third Variation Example

Figure 35:
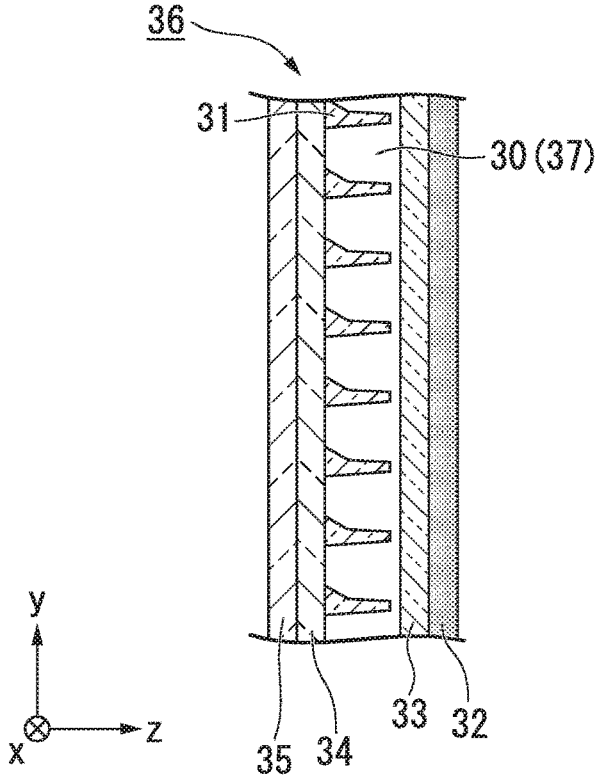
FIG. 35 is a cross-sectional view of a daylighting slat in accordance with a third variation example.

Referring to FIG. 35, each daylighting slat 36 in accordance with a third variation example includes: a daylighting sheet 37 that includes prismatic structural bodies 30; a low-reflective-index-material layer 31; a hard coating layer 32; a base member layer 33; an adhesive layer 34; and a panel 35.

The daylighting slats 36 in accordance with the third variation example, if the slat rotation angle γ of the daylighting slats is adjusted in a suitable manner, can also achieve efficient daylighting while restraining glare.

Daylighting Slat: Fourth Variation Example

Figure 36:
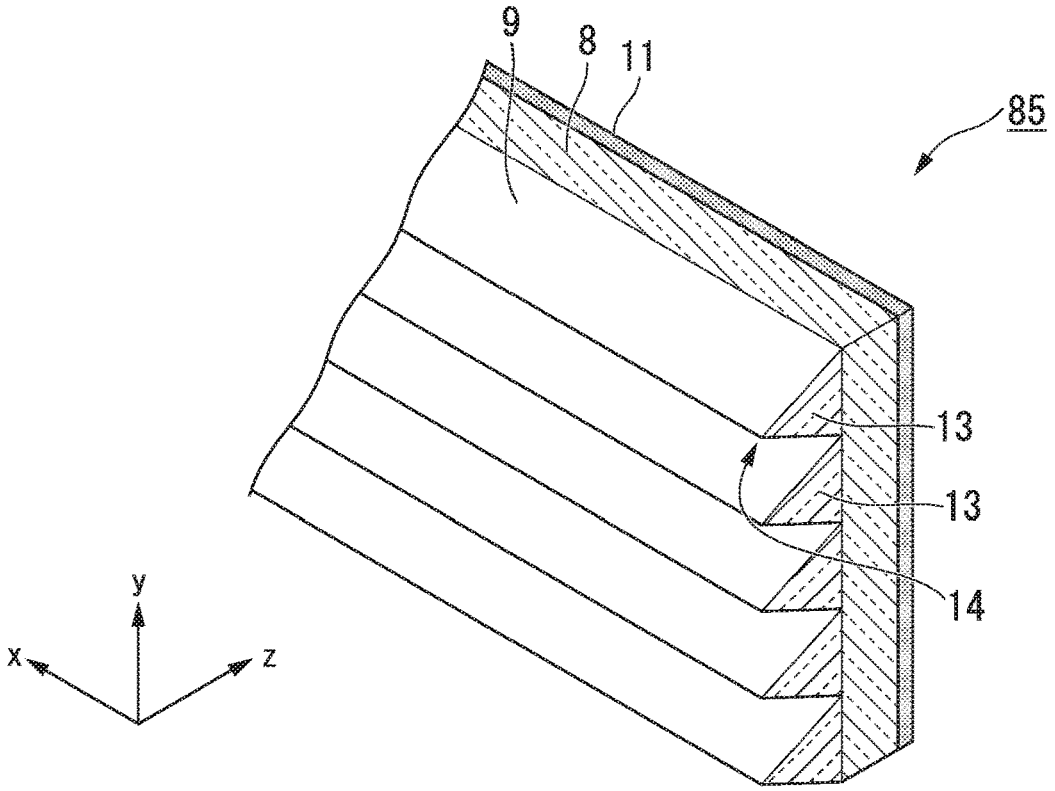
FIG. 36 is a perspective view of a daylighting slat in accordance with a fourth variation example.

Referring to FIG. 36, each daylighting slat 85 in accordance with a fourth variation example includes: a base member 8; a daylighting section 9 that includes prismatic structural bodies 13; and an anisotropic light-diffusion sheet 11. The daylighting slat 85 differs from the previous embodiments in that it includes the anisotropic light-diffusion sheet 11.

The anisotropic light-diffusion sheet 11 is attached to the base member 8 via an adhesive layer (not shown). The anisotropic light-diffusion sheet 11 diffuses, strongly in the horizontal direction, light L that is sequentially emitted from the daylighting section 9 and the base member 8. Specifically, the anisotropic light-diffusion sheet 11 strongly diffuses light L that has exited the base member 8 in a directions that is parallel to the extension direction of the prismatic structural bodies 13 (X direction) rather than in a direction that is perpendicular to the extension direction of the prismatic structural bodies 13 (Y direction).

The anisotropic light-diffusion sheet 11 may be made of, for example, a lenticular lens that includes a plurality of cylindrical lenses. The cylindrical lenses extend along the width of the daylighting slats 85 and are disposed side by side, when viewed perpendicular to the extension direction of the cylindrical lenses. In other words, the arrangement direction (extension direction) of the cylindrical lenses is perpendicular to the arrangement direction (extension direction) of the prismatic structural bodies 13 of the daylighting section 9.

The lens face of each cylindrical lens has a non-zero curvature in the horizontal plane and a zero curvature in the vertical direction. Therefore, the cylindrical lens has a strong light-diffusion property in the horizontal direction and no light-diffusion property in the vertical direction. Therefore, light L is diffused by the anisotropic light-diffusion sheet 11 in the horizontal direction while preserving its vertical angular distribution as it was upon exit from the daylighting section 9 (prismatic structural bodies 13) until it leaves the anisotropic light-diffusion sheet 11.

In this example, the anisotropic light-diffusion sheet 11 is formed separately from the daylighting section 9 and the base member 8. Alternatively, the anisotropic light-diffusion sheet 11 may be integrated with the daylighting section 9 and the base member 8, all into a single piece. For example, the base member 8 may have a second-face side thereof fabricated such that the cylindrical lenses can be an integrated part of the base member 8. The anisotropic light-diffusion sheet 11 is not necessarily made of a lenticular lens and may as an alternative example be made of a translucent sheet that includes a plurality of convex sections all extending in a substantially single direction.

Figure 37:
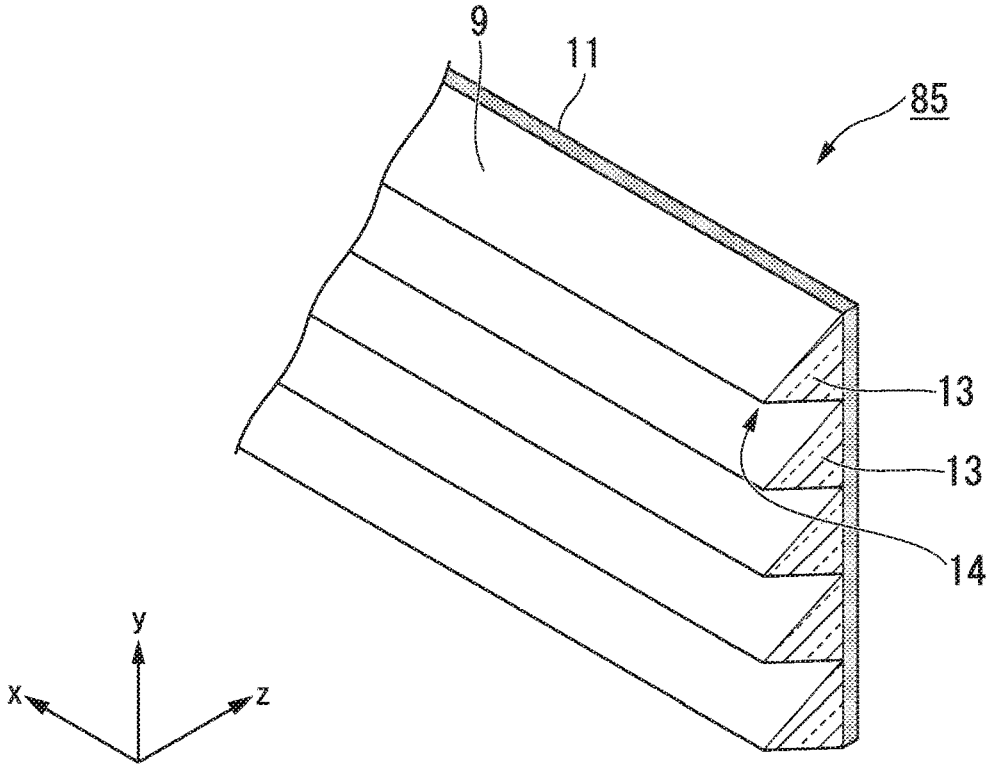
FIG. 37 is a perspective view of another example daylighting slat in accordance with the fourth variation example.

Alternatively, as shown in FIG. 37, a daylighting slat 85 may be used in which the daylighting section 9 and the anisotropic light-diffusion sheet 11 are directly attached using no base member 8.

Daylighting Slat: Fifth Variation Example

Figure 38:
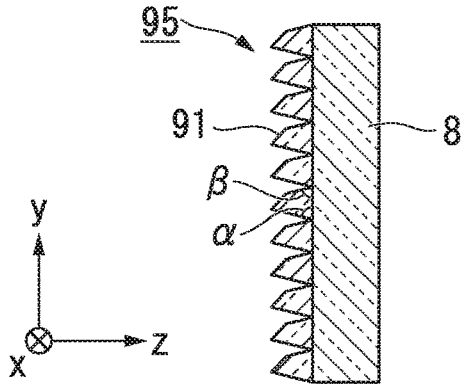
FIG. 38 is a cross-sectional view of a daylighting slat in accordance with a fifth variation example.

Referring to FIG. 38, each daylighting slat 95 in accordance with a fifth variation example includes a base member 8 and a plurality of prismatic structural bodies 91. The prismatic structural bodies 91 are provided on the outdoor side of the base member 8 and have a quadrilateral cross-section.

Daylighting Slat: Sixth Variation Example

Figure 39:
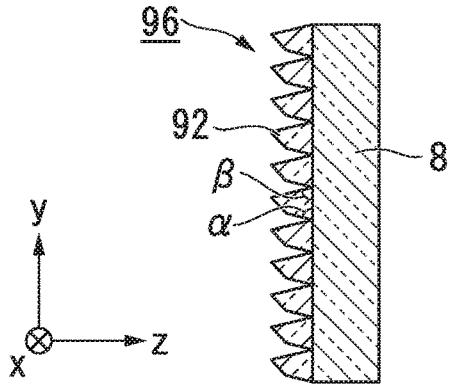
FIG. 39 is a cross-sectional view of a daylighting slat in accordance with a sixth variation example.

Referring to FIG. 39, each daylighting slat 96 in accordance with a sixth variation example includes a base member 8 and a plurality of prismatic structural bodies 92. The prismatic structural bodies 92 are provided on the outdoor side of the base member 8 and have a quadrilateral cross-section.

Daylighting Slat: Seventh Variation Example

Figure 40:
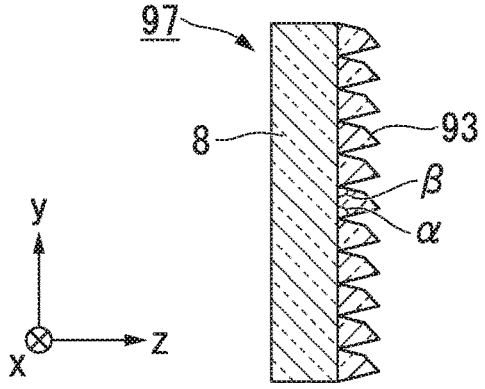
FIG. 40 is a cross-sectional view of a daylighting slat in accordance with a seventh variation example.

Referring to FIG. 40, each daylighting slat 97 in accordance with a seventh variation example includes a base member 8 and a plurality of prismatic structural bodies 93. The prismatic structural bodies 93 are provided on the indoor side of the base member 8 and have a quadrilateral cross-section.

The prismatic structural bodies 91, 92, and 93, although being polygonal in the daylighting slats 95, 96, and 97 of the fifth to seventh variation examples, are only required to have, at least in a part thereof, such a combination of the angles α and β that, among the angles made by the reference face and the faces of the prismatic structural bodies, satisfies the conditions described earlier.

Second Embodiment

The following will describe a second embodiment of the present invention in reference to FIGS. 41 and 42A to 42C.

A daylighting device in accordance with the present embodiment has a basic structure that is identical to that of the first embodiment and differs from the first embodiment in the structure of the daylighting slats.

Figure 41:
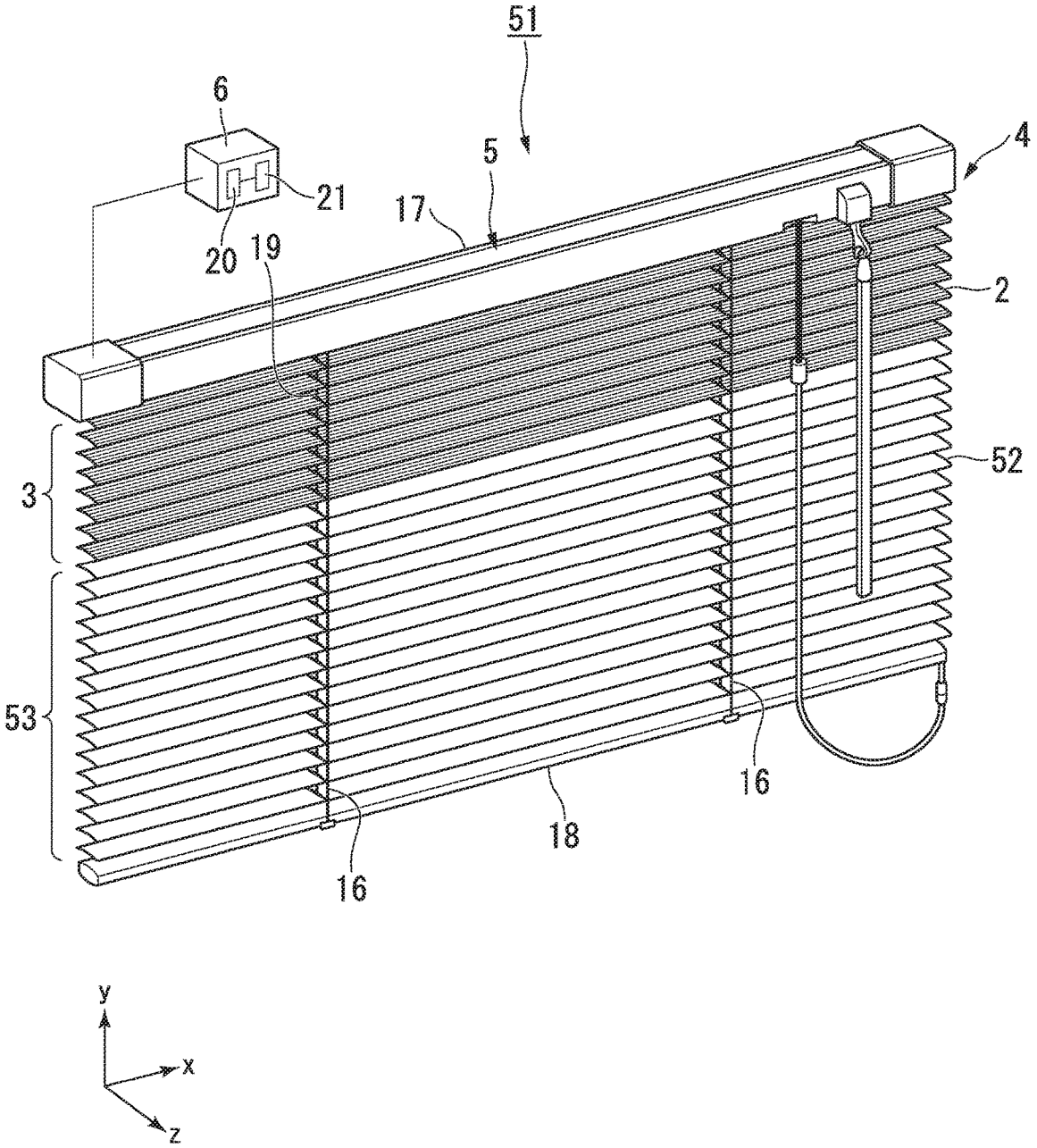
FIG. 41 is a perspective view of a daylighting device in accordance with a second embodiment.

FIG. 41 is a perspective view of a daylighting device in accordance with the second embodiment and corresponds to FIG. 1 for the first embodiment.

Those members in FIGS. 41 and 42A to 42C which are the same as those in the drawings referred to in the first embodiment are indicated by the same reference signs or numerals, and description thereof is omitted.

Referring to FIG. 41, a daylighting device 51 in accordance with the second embodiment includes a plurality of daylighting slats 2, a plurality of shading slats 52, a supporting mechanism 4, a drive mechanism 5, and a control unit 6. The shading slats 52 constitute a shading unit 53. In other words, the first embodiment includes no slats other than the daylighting slats 2, whereas the second embodiment includes both the daylighting slats 2 and the shading slats 52. The daylighting slats 2 bend sunlight in the direction of the ceiling of the room and for this reason are disposed higher than the eyes of desk workers in the room to prevent the desk workers from feeling glare. The shading slats 52 are disposed below the daylighting slats 2.

The daylighting slats 2 in the present embodiment are identical to those in the first embodiment. The shading slats 52 are made of, for example, a metal such as aluminum or a wooden material to block light. The shading slats 52 are not limited in shape in any particular manner so long as the shading slats 52 can block light. Alternatively, the shading slats 52 may be replaced by diffused-transmission slats. Each diffused-transmission slat is, for example, a plate member made of a transparent resin such as polycarbonate and given a light-scattering property to transmit light in a diffuse manner.

The shading slats 52 and the diffused-transmission slats in accordance with the second embodiment correspond to the second slats in claims.

The shading slats 52 are structured such that their angle of inclination is variable. In the second embodiment, the shading slats 52 are rotated in conjunction with the daylighting slats 2 by the drive mechanism 5.

Figure 42A:
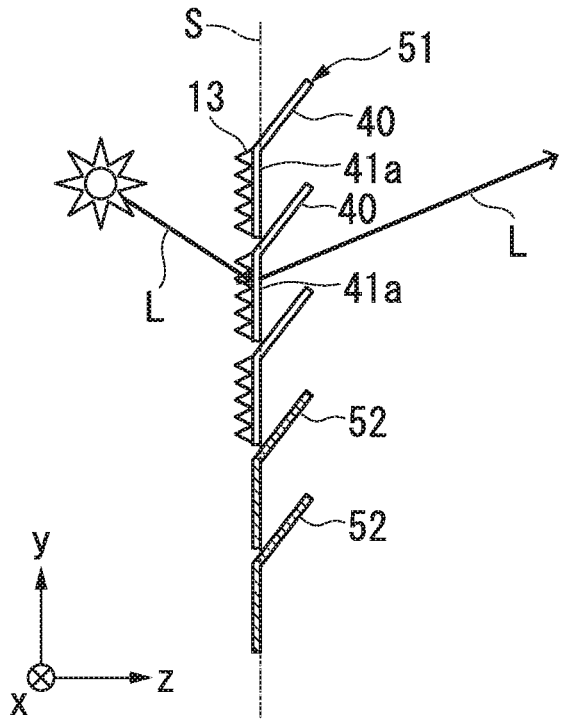
FIG. 42A is a first illustration of an example operating mode of a daylighting device.
Figure 42B:
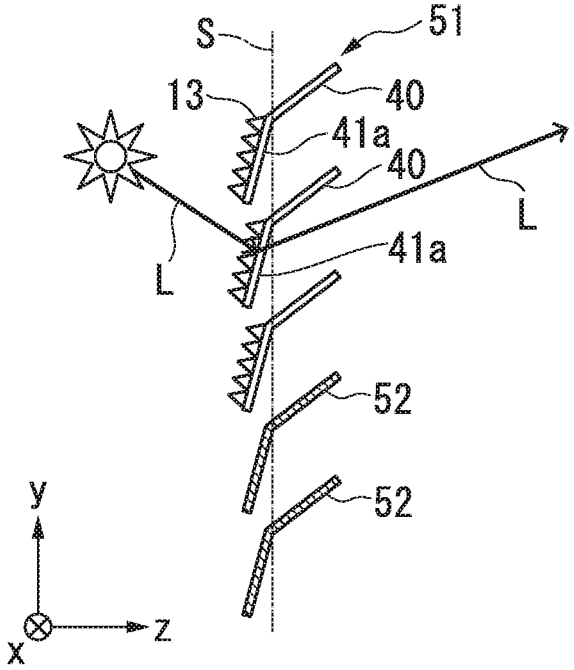
FIG. 42B is a second illustration of the example operating mode of the daylighting device.
Figure 42C:
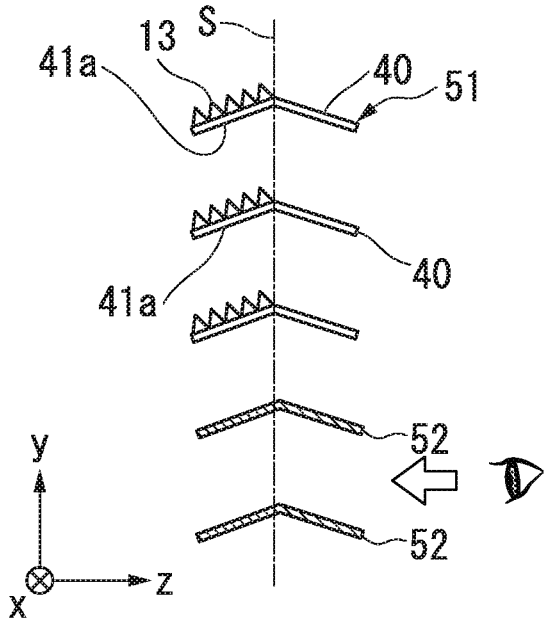
FIG. 42C is a third illustration of the example operating mode of the daylighting device.

In the second embodiment, the daylighting slats 2, which are flat like a plate, may be again replaced by daylighting slats 40 that have a shape obtained by bending a flat plate as shown in FIGS. 42A to 42C.

Referring to FIG. 42A, when the sun's altitude is low, the daylighting slats 40 are positioned such that first area 41A on which there are provided a plurality of daylighting sections are parallel to a light-receiving face S. With the daylighting slats 40 being positioned in this manner, the optical path of sunlight L is bent by the prismatic structural bodies 13 such that sunlight L can be emitted toward the deep part of the room. In the same situation, the shading slats 52 are positioned such that at least a part of each shading slat 52 is parallel to the light-receiving face S. With the shading slats 52 being positioned in this manner, sunlight L is blocked, and the desk workers in the room do not feel glare.

When the sun's altitude is high, if the daylighting slats 40 are not rotated, sunlight L illuminates only near the window, hardly illuminating the deep part of the room. In contrast, in the present embodiment, the daylighting slats 40 are rotatable in such a direction as to tilt the upper part of each daylighting slat 40 away from the light-receiving face S and toward the interior of the room as shown in FIG. 42B. Sunlight L can thereby illuminate the deep part of the room. In this situation, the shading slats 52 are rotated in conjunction with the daylighting slats 40 in such a direction as to tilt the upper part of each shading slat 52 away from the light-receiving face S and toward the interior of the room. There is left a gap between adjacent shading slats 52. When the sun's altitude is high, however, sunlight L hardly enters the room through these gaps between the shading slats 52, and the desk workers in the room do not feel glare.

When there is no need for daylighting, or guiding of direct light into the room, such as at night and when it is cloudy or rainy, the daylighting slats 40 are rotated such that the first area 41A on which the prismatic structural bodies 13 are provided are almost perpendicular to the light-receiving face S, as shown in FIG. 42C. Similarly, the shading slats 52 are also rotated until they are almost perpendicular to the light-receiving face S. This structure improves the see-through visibility that the daylighting device 51 offers, allowing desk workers to view outdoors through the daylighting device 51.

The second embodiment achieves the advantages of providing a daylighting device that is capable of both glare reduction and efficient daylighting. These advantages are similar to those achieved by the first embodiment.

Especially in the second embodiment where the daylighting device 51 includes the shading slats 52, glare can be thoroughly restrained. In addition, since the shading slats 52 are rotated in conjunction with the daylighting slats 2 and 40, there is no need to provide a separate drive mechanism for the shading slats 52, which prevents the structure of the daylighting device 51 from becoming too complex.

Alternatively, the shading slats 52 may be structured so as to be rotated independently from the daylighting slats 2, in which case, the shading slats 52 may be structured to be rotated either automatically or manually. If the shading slats 52 are structured to be rotated independently, there will be provided an additional drive mechanism, but the shading slats 52 can be inclined further toward the interior of the room to a direct-light-blocking angle which is a slat angle by which direct sunlight does not travel into the room. This configuration enhances daylighting.

The shading slats 52 have variable angles of inclination in the present embodiment. Alternatively, the shading slats 52 may have a fixed angle of inclination.

Third Embodiment

The following will describe a third embodiment of the present invention in reference to FIGS. 43 and 44A to 44D.

A daylighting device in accordance with the present embodiment has a basic structure that is identical to that of the first embodiment and differs from the first embodiment in that the former includes a direct-light-detection unit.

Figure 43:
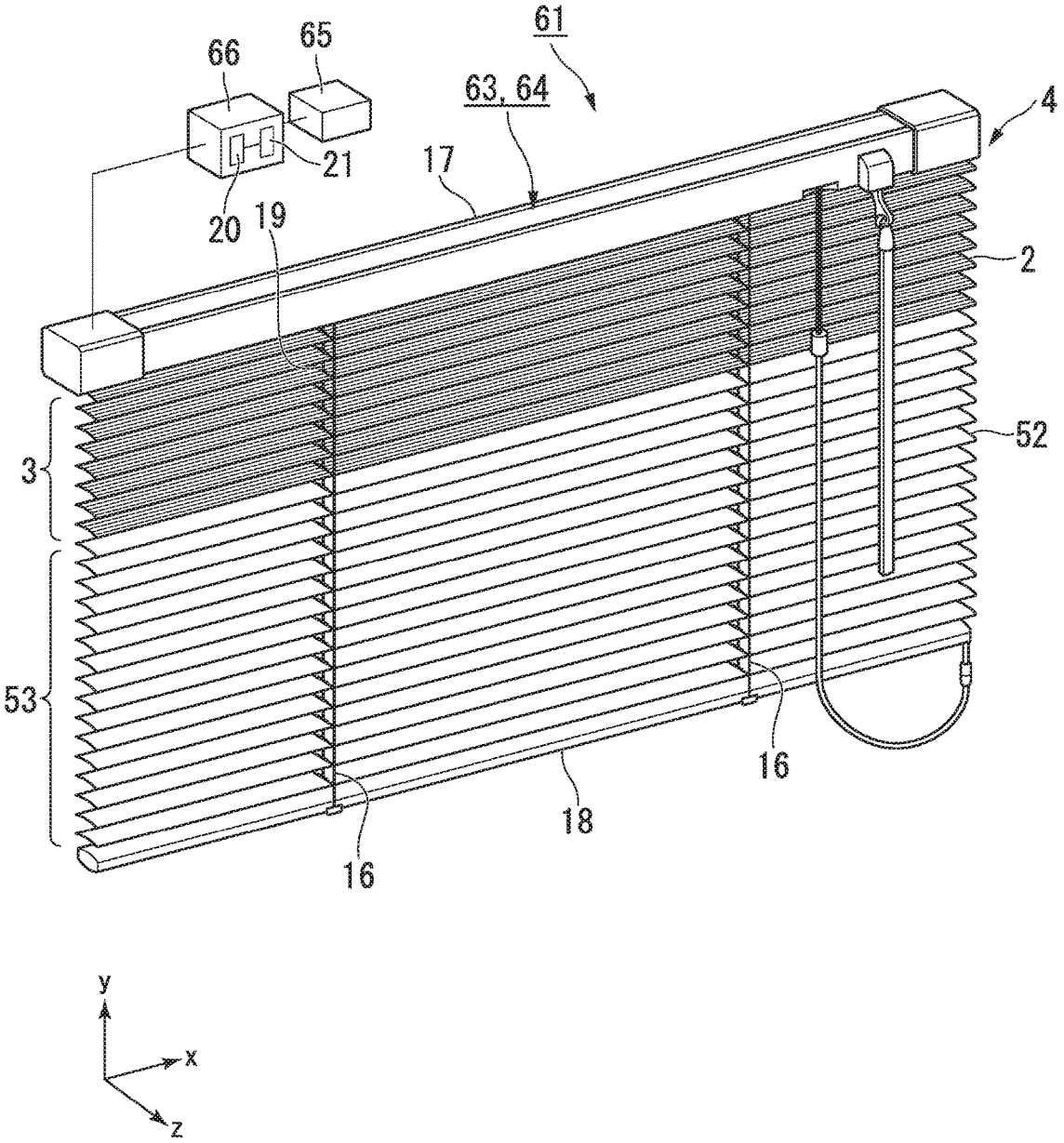
FIG. 43 is a perspective view of a daylighting device in accordance with a third embodiment.

FIG. 43 is a perspective view of a daylighting device in accordance with the third embodiment and corresponds to FIG. 1 for the first embodiment.

Those members in FIGS. 43 and 44A to 44D which are the same as those in the drawings referred to in the first embodiment are indicated by the same reference signs or numerals, and description thereof is omitted.

Referring to FIG. 43, a daylighting device 61 in accordance with the third embodiment includes a plurality of daylighting slats 2, a plurality of shading slats 52, a supporting mechanism 4, a first drive mechanism 63, a second drive mechanism 64, a direct-light-detection unit 65, and a control unit 66. The first drive mechanism 63 and the second drive mechanism 64 are contained in a headbox 17.

Each daylighting slat 2 is structured to be rotated by the first drive mechanism 63 and to have variable angles of inclination. Each shading slat 52 is structured to be rotated by the second drive mechanism 64 and to have variable angles of inclination. In other words, the daylighting device 61 in accordance with the third embodiment includes the second drive mechanism 64 that drives the shading slats 52 independently from the daylighting slats 2. The daylighting slats 2 and the shading slats 52 have the same structures as in the first and second embodiments.

The direct-light-detection unit 65 detects direct light in and around a building in which the daylighting device 61 is installed. The direct-light-detection unit 65 may detect insolation, luminance, illuminance, or any other phenomenon so long as the direct-light-detection unit 65 can detect direct light that the daylighting device 61 receives directly from the sun. The direct-light-detection unit 65 may be any known weather sensor. The direct-light-detection unit 65 may be installed anywhere including, for example, on the rooftop or external wall of a building, near a window of a building, or inside a room of a building. For example, if two or more daylighting devices 61 are installed in a single building, the daylighting devices 61 may share the single direct-light-detection unit 65.

Specifically, the direct-light-detection unit 65 may be, for example, (1) either an illuminance sensor or an insolation sensor that tracks the sun or (2) a fisheye camera. The direct-light-detection unit 65, in the case of (1), includes a first illuminance meter that tracks the sun and a second illuminance meter that measures illuminance attributable to skylight except for the sun and its periphery in the sky. The direct-light-detection unit 65 determines whether it is sunny or cloudy from a difference between measurements given by the two illuminance meters, in order to control the slats. In the case of (2), the direct-light-detection unit 65 captures an image of the whole sky on a fisheye camera and checks insolation on the basis of at least one of indicators (i.e., luminance level, R level, B level, and G level) in a plurality of regions into which the whole sky is divided, in order to determine weather.

In the third embodiment, the daylighting slats 2, which are flat like a plate, may be again replaced by daylighting slats 40 that have a shape obtained by bending a flat plate as shown in FIGS. 44A to 44D.

In the third embodiment, the control unit 66 controls the angle of inclination of the daylighting slats 2 on the basis of a quantity of direct insolation as detected by a direct-insolation-quantity-detection unit 65.

Figure 44A:
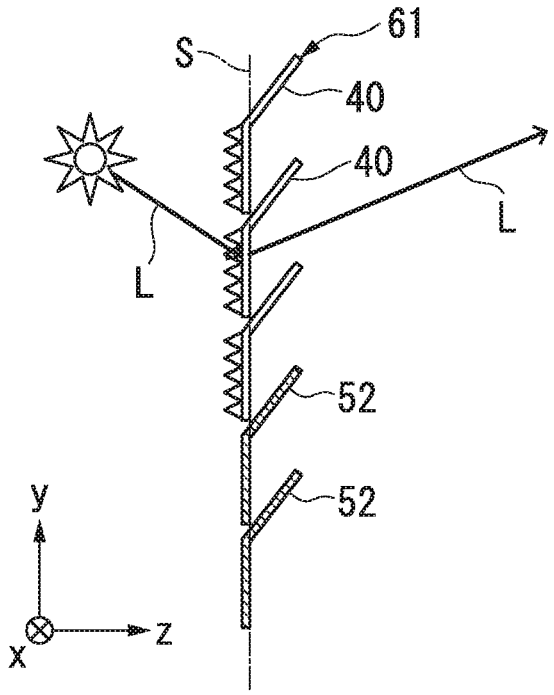
FIG. 44A is a first illustration of another example operating mode of a daylighting device.
Figure 44B:
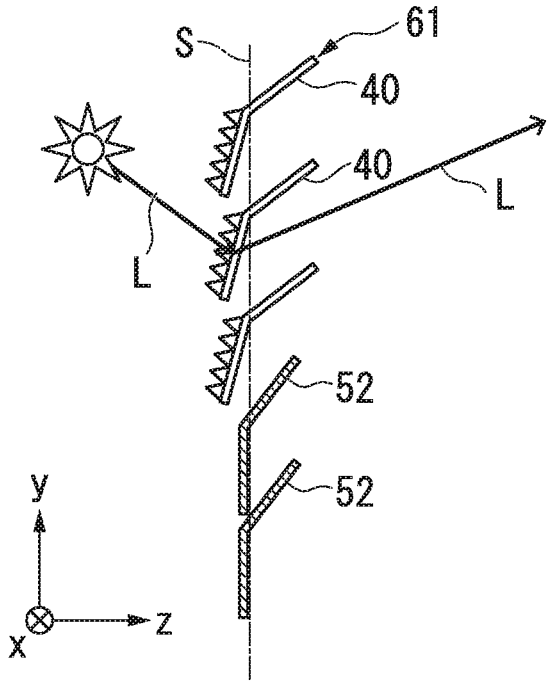
FIG. 44B is a second illustration of the other example operating mode of the daylighting device.

For example, if the control unit 66 has determined, when it is sunny, that the quantity of direct insolation exceeds a prescribed threshold value, the control unit 66 controls the daylighting slats 40 in accordance with the sun's altitude similarly to the second embodiment, to an angle of inclination at which the daylighting slats 40 can guide light to the deep part of the room, and also controls the shading slats 52 either to the direct-light-blocking angle or so as to fully close the shading slats 52, as shown in FIGS. 44A and 44B.

Figure 44C:
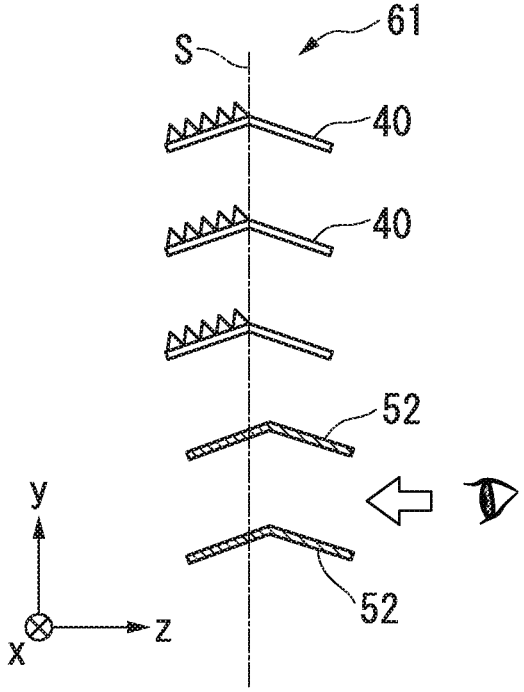
FIG. 44C is a third illustration of the other example operating mode of the daylighting device.

On the other hand, if the control unit 66 has determined, when it is cloudy or rainy, that the quantity of direct insolation is less than or equal to a prescribed threshold value, for example, the control unit 66 controls both the daylighting slats 40 and the shading slats 52 to be horizontal as shown in FIG. 44C in order to ensure see-through visibility and to enhance daylighting.

Figure 44D:
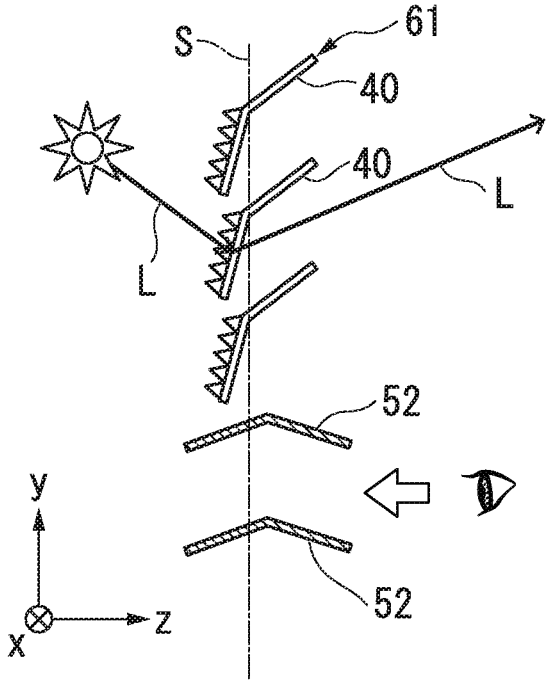
FIG. 44D is a fourth illustration of the other example operating mode of the daylighting device.

Alternatively, assuming that the distribution of luminance be uniform across the sky when it is cloudy or rainy, an angle of slat inclination may be predetermined at which the quantity of guided light reaches a maximum as shown in FIG. 44D, in order to control the daylighting slats 40. In this manner, if the control unit 66 has determined that the quantity of direct insolation is less than or equal to a prescribed threshold value, the control unit 66 may control the daylighting slats 40 to a predetermined angle of inclination.

The daylighting device 61 may potentially receive not only direct insolation, but also reflection from surrounding buildings. If the memory 21 in the control unit 66 contains, for example, the locations and heights of surrounding buildings and information on the installation sites of the daylighting devices 61 in the buildings, the control unit 66 can determine whether or not there exists such reflection. The amount of this reflected light may be factored in in determining whether to open or close the slats.

The third embodiment achieves the advantages of providing a daylighting device that is capable of both glare reduction and efficient daylighting. These advantages are similar to those achieved by the first and second embodiments.

Especially in the third embodiment where the control unit 66 controls the angle of inclination of the daylighting slats 2 and 40 and the shading slats 52 on the basis of the quantity of direct insolation, see-through visibility is ensured particularly when it is cloudy or rainy as well as both efficient daylighting and reduced glare are achieved in accordance with the quantity of direct insolation. In addition, since the shading slats 52 are rotated independently from the daylighting slats 2 and 40, the daylighting slats 2 and 40 and the shading slats 52 can be controlled separately to an optimal angle of inclination.

Fourth Embodiment

Figure 45A:
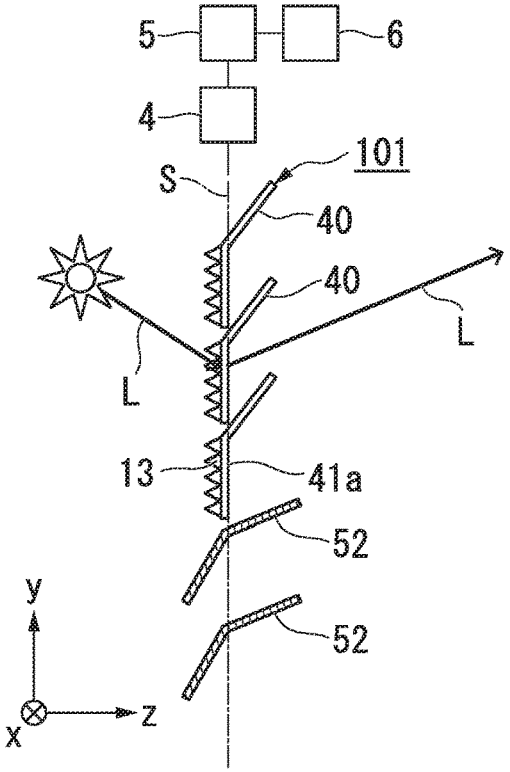
FIG. 45A is a first illustration of an example operating mode of a daylighting device in accordance with a fourth embodiment.
Figure 45B:
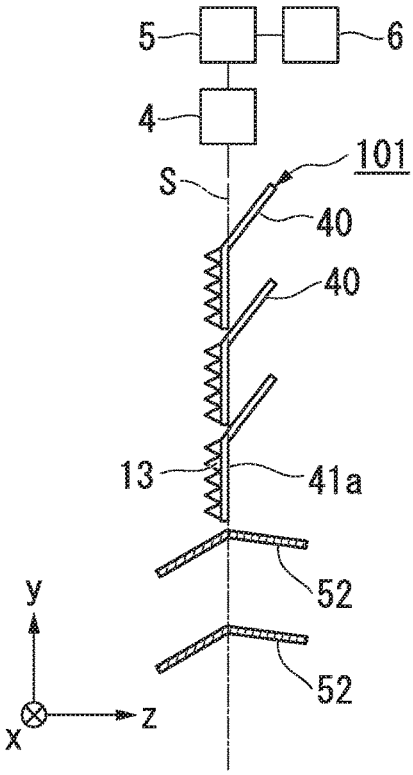
FIG. 45D is a second illustration of the example operating mode of the daylighting device in accordance with the fourth embodiment.
FIG. 45C is a third illustration of the example operating mode of the daylighting device in accordance with the fourth embodiment.
Figure 45C:
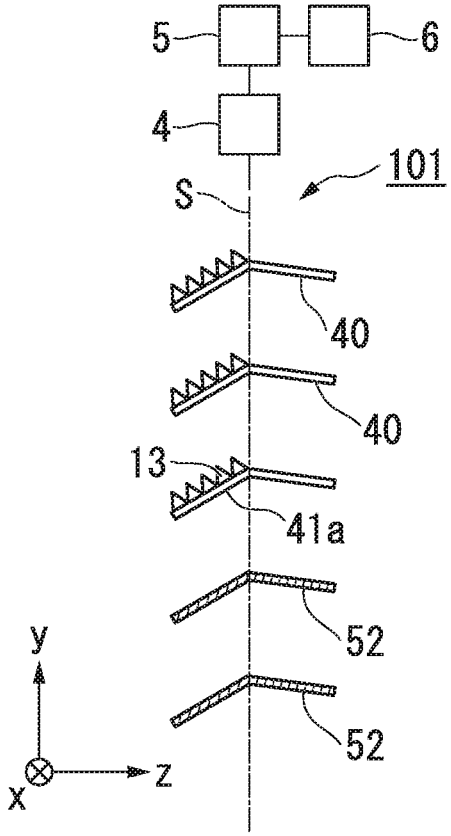

The following will describe a fourth embodiment of the present invention in reference to FIGS. 45A to 45C.

A daylighting device in accordance with the present embodiment has a basic structure that is identical to that of the second embodiment and differs from the second embodiment in how the daylighting slats operate.

FIG. 45A is a first illustration of an example operating mode of a daylighting device in accordance with the fourth embodiment. FIG. 45B is a second illustration of the example operating mode of the daylighting device in accordance with the fourth embodiment. FIG. 45C is a third illustration of the example operating mode of the daylighting device in accordance with the fourth embodiment.

Those members in FIGS. 45A to 45C which are the same as those in the drawings referred to in the second embodiment are indicated by the same reference signs or numerals, and description thereof is omitted.

Referring to FIG. 45A, a daylighting device 101 in accordance with the fourth embodiment includes a plurality of daylighting slats 40, a plurality of shading slats 52, a supporting mechanism 4, a drive mechanism 5, and a control unit 6. In other words, the fourth embodiment includes both the daylighting slats 40 and the shading slats 52, as does the second embodiment. The daylighting slats 40 are disposed higher than the eyes of desk workers in the room. The shading slats 52 are disposed below the daylighting slats 40.

The daylighting slats 40 per se have the same structure as the daylighting slats 2 in accordance with the first embodiment. The daylighting slats 40 may be rotatable either manually or automatically by the drive mechanism 5. The shading slats 52 per se in the present embodiment have the same structure as the shading slats 52 in accordance with the second embodiment. The shading slats 52 in the present embodiment are structured to be rotated automatically by the drive mechanism 5.

To put it differently, the drive mechanism 5 in the fourth embodiment drives either the daylighting slats 40 or the shading slats 52 or both. The control unit 6 controls the drive mechanism 5 to change the angle of inclination of those slats in accordance with the position of the sun.

When it is sunny, in the daylighting device 101 in accordance with the fourth embodiment, the daylighting slats 40 are fixed with the first area 41A on which a plurality of daylighting sections are provided being positioned parallel to a light-receiving face S as shown in FIG. 45A. In other words, when it is sunny, the control unit 6 does not perform any control that changes the angle of inclination of the daylighting slats 40. Consequently, the optical path of sunlight L is bent by the prismatic structural bodies 13 such that sunlight L can be emitted toward the deep part of the room.

When it is sunny, the shading slats 52 are controlled by the control unit 6 in accordance with the position of the sun in such a manner that the angle of inclination thereof equals the direct-light-blocking angle. Consequently, sunlight L is blocked in a suitable manner, and the desk workers in the room do not feel glare.

On the other hand, when it is cloudy, the daylighting slats 40 may be positioned such that the first area 41A on which there are provided a plurality of daylighting sections are parallel to the light-receiving face S as shown in FIG. 45B. Alternatively, as shown in FIG. 45C, the daylighting slats 40 may be positioned such that the first area 41A on which there are provided a plurality of daylighting sections are almost perpendicular to the light-receiving face S. Furthermore, the daylighting slats 40 may take a position somewhere between the positions shown in FIGS. 45B and 45C. When it is cloudy, the positions of the daylighting slats 40 may be manually adjusted or electrically controlled.

When it is cloudy, the shading slats 52 are controlled by the control unit 6, for example, so as to be almost perpendicular to the light-receiving face S.

The fourth embodiment achieves the advantages of providing a daylighting device that is capable of both glare reduction and efficient daylighting. These advantages are similar to those achieved by the first embodiment.

Especially in the fourth embodiment where the daylighting slats 40 include prismatic structural bodies that allow large contribution from the light that undergoes an even number of reflection (refracted light, double-reflection light), glaring light may occur upon the rotation of the daylighting slats 40 to some angles. Meanwhile, although the daylighting slats 40 need to be disposed higher than the eyes of desk workers in the room, a low ceiling in a building may not allow the daylighting slats 40 to be disposed sufficiently higher than the eyes of desk workers in the room. Under these conditions, in a configuration where either one of the two kinds of slats or both are electrically controlled as in the fourth embodiment, more light may be guided into the room by electrically controlling the shading slats 52, not the daylighting slats 40. In this manner, the present embodiment offers an increased number of combinations of slat operation options in guiding more light into the room in accordance with weather and outdoor brightness.

Fifth Embodiment

Figure 46:
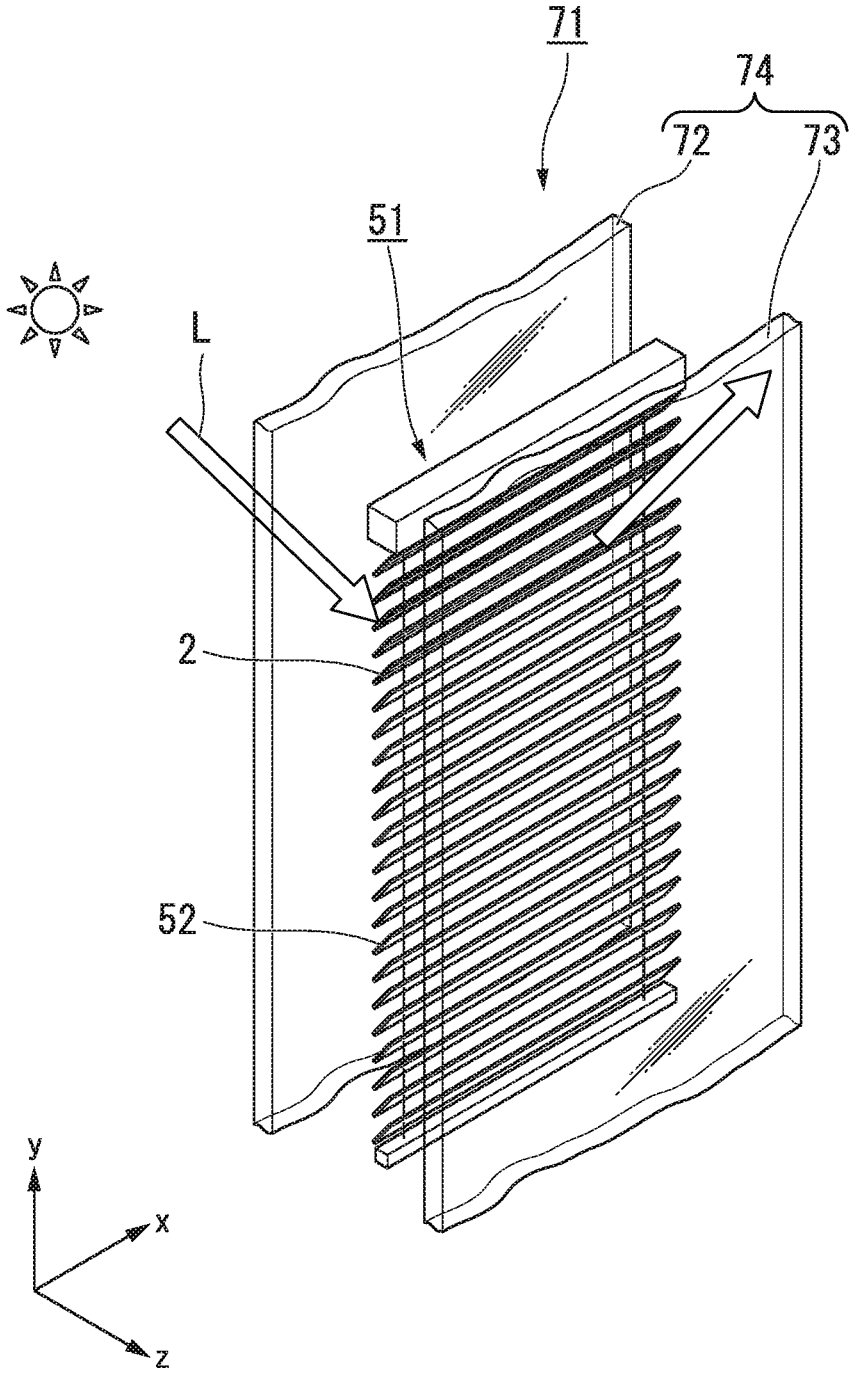
FIG. 46 is a perspective view of a daylighting system in accordance with a fifth embodiment.
Figure 47:
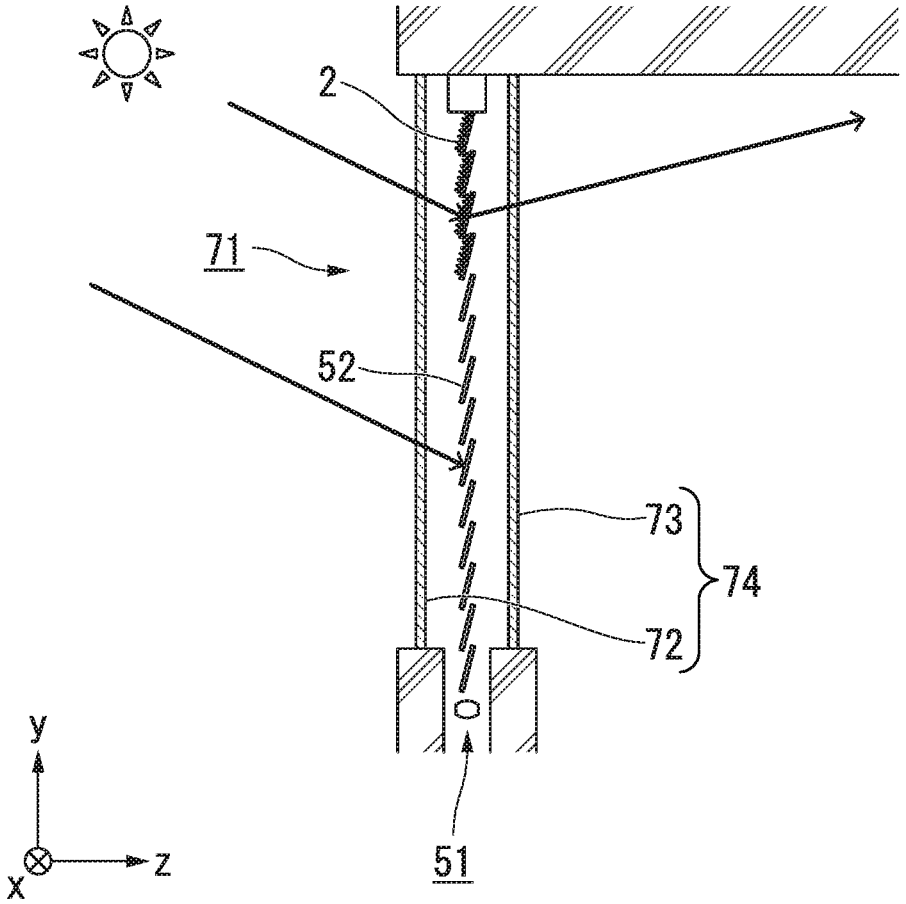
FIG. 47 is a cross-sectional view of a daylighting system.

The following will describe a fifth embodiment of the present invention in reference to FIGS. 46 and 47.

In the present embodiment, a description will be given of an example daylighting system that includes one of the daylighting devices of the first to fourth embodiments.

FIG. 46 is a perspective view of a daylighting system in accordance with the fifth embodiment.

FIG. 47 is a cross-sectional view of the daylighting system.

Those members in FIGS. 46 and 47 which are the same as those in the drawings referred to in the first embodiment are indicated by the same reference signs or numerals, and description thereof is omitted.

Referring to FIGS. 46 and 47, a daylighting system 71 includes a daylighting device 51 and a multilayered glass unit 74. The multilayered glass unit 74 includes a pair of opposing glass plates separated by a distance. The daylighting device 51 is disposed between an outdoor glass plate 72 and an indoor glass plate 73 that constitute the multilayered glass unit 74. FIGS. 46 and 47 show an example of the daylighting device 51 of the second embodiment that includes the daylighting slats 2 and the shading slats 52. This is a mere example, and any one of the daylighting devices of the first to fourth embodiments may be used.

Since the daylighting system 71 in accordance with the present embodiment includes one of the daylighting devices of the first to fourth embodiments, the daylighting system 71 achieves reduced glare and efficient daylighting.

Since the daylighting device 51 is disposed inside the multilayered glass unit 74, the daylighting device 51 is protected from water, impact force, and other like external factors that may deform or change the nature of the slats. Therefore, the daylighting slats 2 and the shading slats 52 are not easily degraded, and their daylighting and light-blocking effects are sufficiently preserved. In addition, since the daylighting device 51 is integrated into a window to form the daylighting system 71, the presence/absence of the daylighting device 51 is less apparent, which gives a uniform appearance to the building.

Lighting-Modulation System

Figure 48:
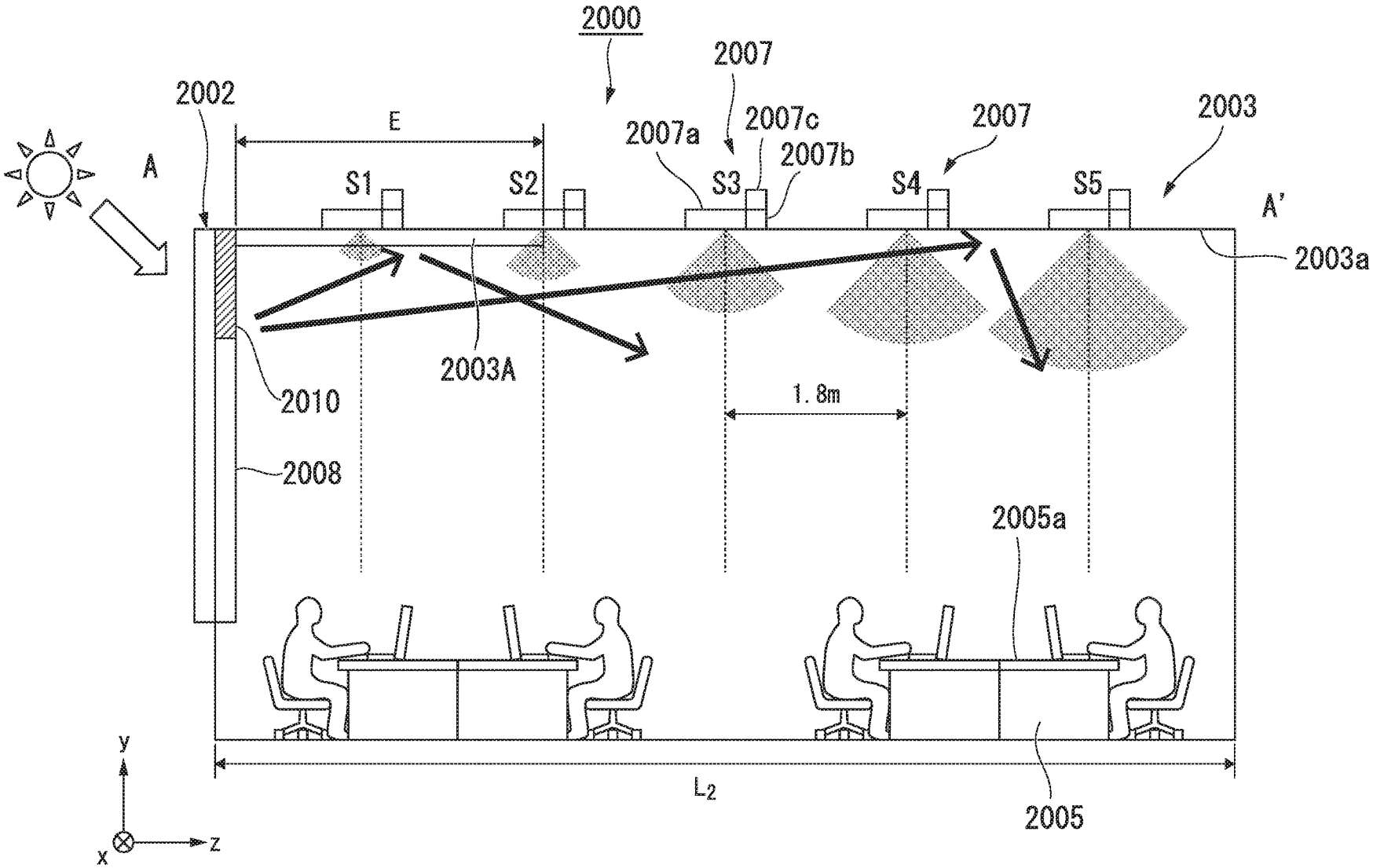
FIG. 48 is an illustration which shows a room model in which a daylighting device and a lighting-modulation system are installed.
Figure 49:
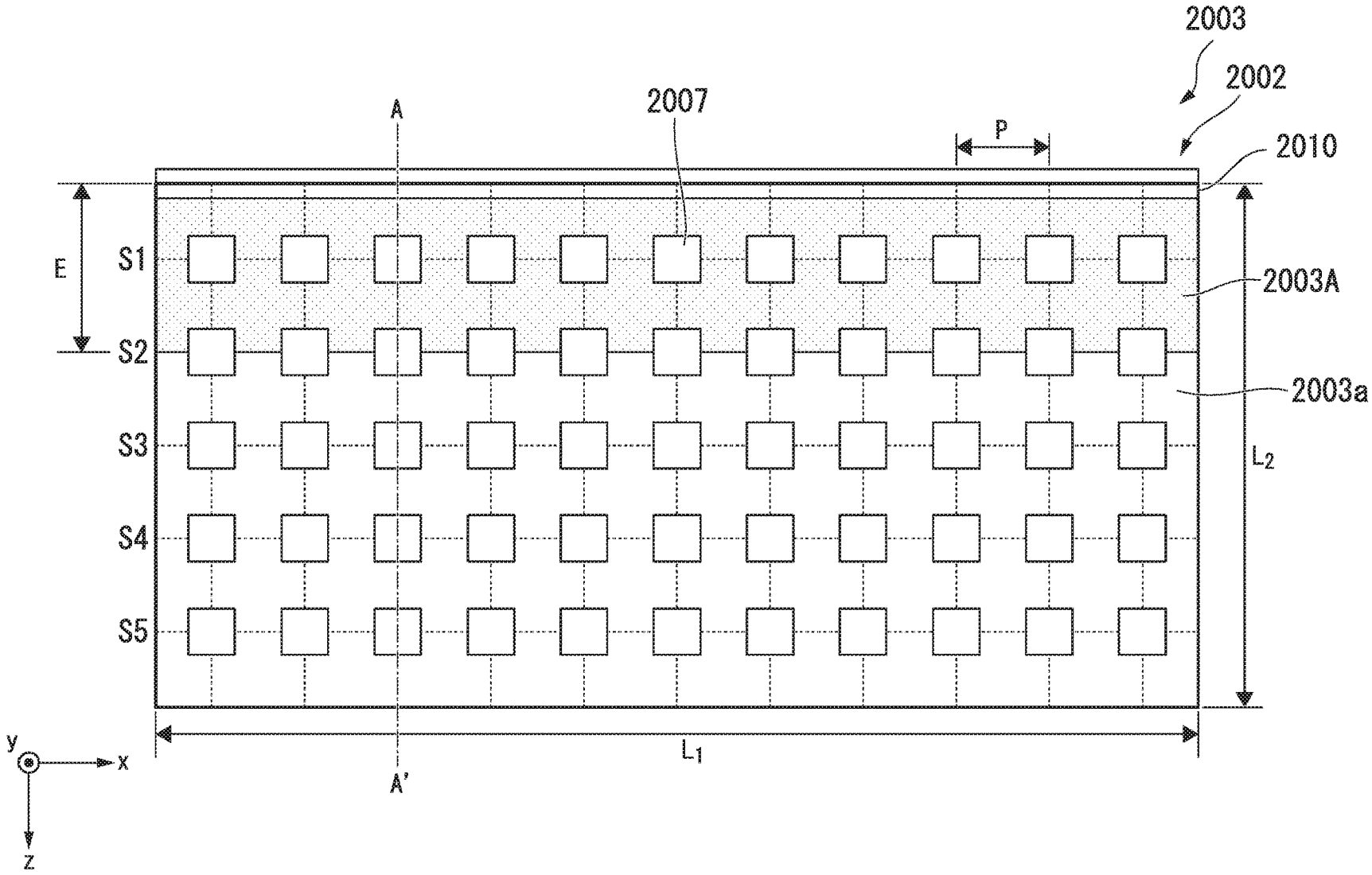
FIG. 49 is a plan view of a ceiling of the room.

FIG. 48 is a cross-sectional view, taken along line A-A' in FIG. 49, of a room model 2000 in which a daylighting device and a lighting-modulation system are installed.

FIG. 49 is a plan view of a ceiling of the room model 2000.

A room 2003 into which sunlight is guided has a ceiling 2003*a* constituted partly by a ceiling material that may have strong light-reflecting properties. Referring to FIGS. 48 and 49, the ceiling 2003*a* of the room 2003 is provided with a light-reflecting ceiling material 2003A as a ceiling material having such light-reflecting properties. The light-reflecting ceiling material 2003A is for facilitating the guiding of outdoor light from a daylighting device 2010 installed over a window 2002 deep into the interior. The light-reflecting ceiling material 2003A is disposed on a part of the ceiling 2003*a* close to the window, specifically, on a predetermined part E of the ceiling 2003*a* (approximately up to 3 meters from the window 2002).

The light-reflecting ceiling material 2003A, as described above, serves to efficiently direct deep into the interior the sunlight guided indoors through the window 2002 on which the daylighting device 2010 (any one of the daylighting devices of the embodiments described earlier) is installed. The sunlight guided in the direction of the indoor ceiling 2003*a* by the daylighting device 2010 is reflected by the light-reflecting ceiling material 2003A, hence changing direction and illuminating a desk top face 2005*a* of a desk 2005 located deep in the interior. Thus, the light-reflecting ceiling material 2003A has the advantage of lighting up the desk top face 2005*a*.

The light-reflecting ceiling material 2003A may be either diffuse reflective or specular reflective. Preferably, the light-reflecting ceiling material 2003A has a suitable mix of these properties to achieve both the advantage of lighting up the desk top face 2005*a* of the desk 2005 located deep in the interior and the advantage of reducing glare which is uncomfortable to the room occupant.

Much of the light guided indoors by the daylighting device 2010 travels in the direction of the part of the ceiling that is close to the window 2002. Still, the part of the interior close to the window 2002 often has sufficient lighting. Therefore, the light that strikes the ceiling near the window (part E) can be partially diverted to a deep part of the room where lighting is poor compared to the part near the window, by additionally using the light-reflecting ceiling material 2003A described here.

The light-reflecting ceiling material 2003A may be manufactured, for example, by embossing convexities and concavities each of approximately a few tens of micrometers on an aluminum or like metal plate or by vapor-depositing a thin film of aluminum or a like metal on the surface of a resin substrate having such convexities and concavities formed thereon. Alternatively, the embossed convexities and concavities may be formed from a curved surface with a higher cycle.

Furthermore, the embossed shape formed on the light-reflecting ceiling material 2003A may be changed as appropriate to control light distribution properties thereof and hence resultant indoor light distribution. For example, if stripes extending deep into the interior are embossed, the light reflected by the light-reflecting ceiling material 2003A is spread to the left and right of the window 2002 (in the directions that intersect the length of the convexities and concavities). When the window 2002 is limited in size or orientation, these properties of the light-reflecting ceiling material 2003A may be exploited to diffuse light in horizontal directions and at the same time to reflect the light deep into the room.

The daylighting device 2010 is used as a part of a lighting-modulation system for the room 2003. The lighting-modulation system includes, for example, the daylighting device 2010, a plurality of room lighting devices 2007, an insolation adjustment device 2008 installed over the window, a control system for these devices, the light-reflecting ceiling material 2003A installed on the ceiling 2003*a*, and all the other structural members of the room.

The window 2002 of the room 2003 has the daylighting device 2010 installed thereover in such a manner that the daylighting slats are positioned over an upper portion thereof and the shading slats are positioned over a lower portion thereof. In this example, the daylighting device 2010 is one in accordance with the second embodiment, which is by no means intended to limit the scope of the invention.

In the room 2003, the room lighting devices 2007 are arranged in a lattice in the left/right direction as viewed from the window 2002 (Y direction) and in the depth direction of the room (Z direction). These room lighting devices 2007, in combination with the daylighting device 2010, constitute an illumination system for the whole room 2003.

Referring to FIGS. 48 and 49 illustrating the office ceiling 2003*a*, for example, the room 2003 has a width $L_1$ of 18 meters in the left/right direction as viewed from the window 2002 (X direction) and a depth $L_2$ of 9 meters (Z direction). The room lighting devices 2007 in this example are arranged in a lattice with pitches P each of 1.8 meters in the width (X direction) and depth (Z direction) of the ceiling 2003*a*. More specifically, a total of 50 room lighting devices 2007 is arranged in a lattice of 11 rows (X direction) and 5 columns (Z direction).

Each room lighting device 2007 includes an interior lighting fixture 2007*a*, a brightness detection unit 2007*b*, and a control unit 2007*c*. The brightness detection unit 2007*b* and the control unit 2007*c* are integrated into the interior lighting fixture 2007*a* to form a single structural unit.

Each room lighting device 2007 may include two or more interior lighting fixtures 2007*a* and two or more brightness detection units 2007*b*, with one brightness detection unit 2007*b* for each interior lighting fixture 2007*a*. The brightness detection unit 2007*b* receives reflection off the face illuminated by the interior lighting fixture 2007*a* to detect illuminance on that face. In this example, the brightness detection unit 2007*b* detects illuminance on the desk top face 2005*a* of the desk 2005 located in the room.

The control units 2007*c*, each for a different one of the room lighting devices 2007, are connected to each other. In each room lighting device 2007, the control unit 2007*c*, connected to the other control units 2007*c*, performs feedback control to adjust the light output of an LED lamp in the interior lighting fixture 2007*a* such that the illuminance on the desk top face 2005*a* detected by the brightness detection unit 2007*b* is equal to a predetermined target illuminance $L_0$ (e.g., average illuminance: 750 1×).

Figure 50:
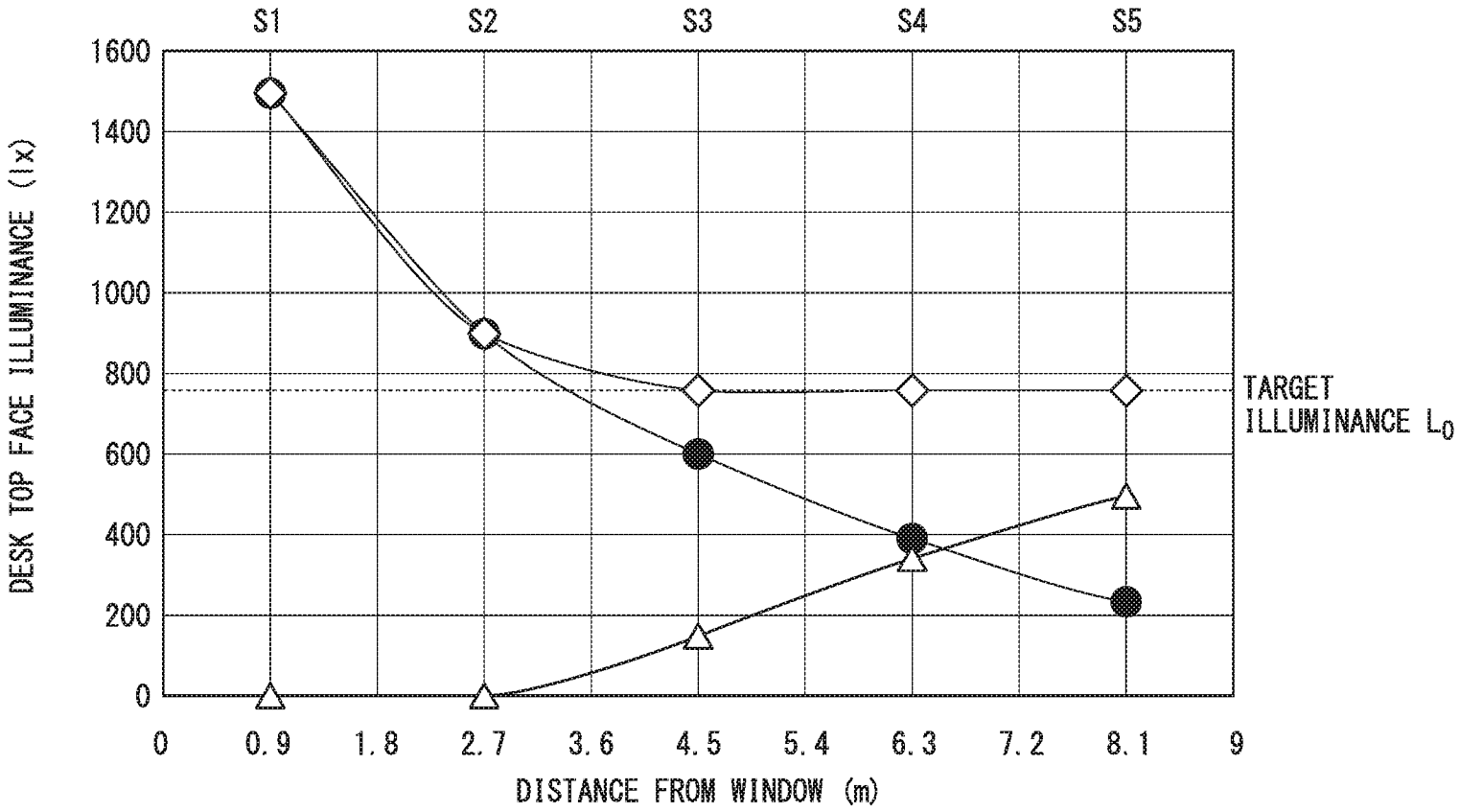
FIG. 50 is a graph representing a relationship between the illuminance produced by daylighting light (natural light) guided indoors by a daylighting device and the illuminance produced by room lighting devices (lighting-modulation system).

FIG. 50 is a graph representing a relationship between the illuminance produced by the daylighting light (natural light) guided into the interior by the daylighting device and the illuminance produced by the room lighting devices (lighting-modulation system). In FIG. 50, the vertical axis indicates illuminance (1×) on the desk top face, and the horizontal axis indicates distance (meters) from the window. The broken line in the figure represents a target indoor illuminance. Each black circle denotes an illuminance produced by the daylighting device, each white triangle denotes an illuminance produced by the room lighting devices, and each white diamond denotes a total illuminance.

Referring to FIG. 50, the desk top face illuminance attributable to the daylighting light guided by the daylighting device 2010 is highest at the window, and the daylighting light's effect decreases with increasing distance from the window. This illuminance distribution in the depth direction of the room is caused during the daytime by natural daylight coming through a window into the room in which the daylighting device 2010 is installed. Accordingly, the daylighting device 2010 is used in combination with the room lighting devices 2007 which enhance the indoor illuminance distribution.

The room lighting devices 2007, disposed on the indoor ceiling, detect an average illuminance below them by means of the brightness detection units 2007*b* and light up in a modulated manner such that the desk top face illuminances across the whole room are equal to the predetermined target illuminance $L_0$. Therefore, columns S1 and S2 are near the window and only dimly light up, whereas columns S3, S4, and S5 light up so as to produce an output that increases with increasing depth into the room. Consequently, the desk top faces across the whole room are lit up by the sum of the illumination by natural daylight and the illumination by the room lighting devices 2007 at a desk top face illuminance of 750 1×, which is regarded as being sufficient for desk work (see, JIS Z9110, General Rules on Lighting, Recommended Illuminance in Offices).

As described above, light can be delivered deep into the room by using both the daylighting device 2010 and the lighting-modulation system (room lighting devices 2007) together. This can in turn further improve indoor brightness and ensure a sufficient desk top face illuminance for desk work across the whole room, hence providing a more stable, brightly lit environment independently from the season and the weather.

The technical scope of the present invention is by no means limited to the embodiments and examples described above. The invention may be altered in various manners within its spirit.

For example, in the embodiments, the control unit automatically controls the daylighting slats as an example. In place of this configuration, for example, the daylighting device may include a remote controller (input unit) for externally inputting a posture for the daylighting slats. When this is the case, the control unit controls the angle of inclination of the daylighting slats on the basis of signals inputted from the remote controller.

Additionally, for example, the specific number, layout, shape, dimensions, and composition of members of the daylighting device and the daylighting system may be altered in a suitable manner.

INDUSTRIAL APPLICABILITY

The present invention, in one aspect thereof, is applicable, for example, to daylighting devices and daylighting systems for guiding outdoor light such as sunlight into a room.

REFERENCE SIGNS LIST

1, 51, 61, 101 Daylighting Device
2, 26, 36, 40, 85, 86 Daylighting Slat (First Slat)
5, 63 Drive Mechanism (First Drive Mechanism)
6, 66 Control Unit
13, 25, 30, 42, 80 Prismatic Structural Body
14 Gap Portion
21 Memory (Memory Unit)
52 Shading Slat (Second Slat)
64 Second Drive Mechanism
65 Direct-insolation-quantity-detection Unit
71 Daylighting System
74 Multilayered Glass Unit
2007 Room Lighting Device
2007*b* Brightness Detection Unit

The invention claimed is:

1. A daylighting device comprising:
a first transparent slat configured to bend an optical path of incident light from an outdoor direction so as to emit the incident light in a prescribed indoor direction;
a first drive mechanism configured to drive the first transparent slat; and
a control unit configured to control the first drive mechanism so as to change an angle of inclination of the first transparent slat in accordance with a position of the sun.

2. The daylighting device according to claim 1,
wherein the first transparent slat includes a plurality of prismatic structural bodies configured to change a traveling direction of light in a vertical plane.

3. The daylighting device according to claim 2, wherein the prismatic structural bodies each have at least:
a first face serving primarily as a reflection face for the incident light and making an angle $\alpha$ with a reference face for the first transparent slat; and
a second face serving as an entrance face or an exit face for the incident light and making an angle $\beta$ with the reference face.

4. The daylighting device according to claim 3,
further comprising a memory unit configured to store either a correlation between a date and time and the angle of inclination of the first transparent slat or a correlation between an angle of incidence of light to the first transparent slat and the angle of inclination of the first transparent slat,
wherein the control unit controls the angle of inclination of the first transparent slat based on the correlation stored in the memory unit.

5. The daylighting device according to claim 3,
further comprising a memory unit configured to store a correlation,
$\theta out=f(\theta in, \varphi in, \gamma)$, between $\theta in$, $\varphi in$, $\gamma$, and $\theta out$, where
$\theta in$ is an incident angle of altitude of direct light on a horizontal plane,
$\varphi in$ is an incident angle of orientation of the direct light with respect to the daylighting device,
$\gamma$ is the angle of inclination of the first transparent slat, and
$\theta out$ is an emission angle of altitude of the direct light that exits the first transparent slat.

6. The daylighting device according to claim 5, wherein:
$\gamma$ has a negative value when the first transparent slat is rotated in such a direction as to tilt an upper portion of the first transparent slat toward an interior of a room and has a positive value
when the first transparent slat is rotated in such a direction as to tilt the upper portion toward an exterior of the room; and
the control unit derives a minimum value of $\gamma$ that satisfies $\theta out=f(\theta in, \varphi in, \gamma)\geq\delta$,
where $\delta$ is an offset angle from the horizontal plane of light exiting the first transparent slat.

7. The daylighting device according to claim 6,
wherein the control unit determines the offset angle $\delta$ based on a location of a lower end of the first transparent slat and a depth of a room in which the daylighting device is installed.

8. The daylighting device according to claim 5,
wherein the correlation is related to direct light reflected once inside the prismatic structural bodies.

9. The daylighting device according to claim 5, further comprising an input unit configured to enable external input of a posture for the first transparent slat,
wherein the control unit controls the angle of inclination of the first transparent slat based on the correlation and a signal obtained from the input unit.

10. The daylighting device according to claim 3, wherein: the first and second faces of the prismatic structural bodies are provided so as to face outdoors; and each of the prismatic structural bodies has, at least in a part thereof, such a combination of the angles $\alpha$ and $\beta$ that $0°<\alpha 90°$, $0°\leq\beta\leq 90°$, and $\alpha\geq\beta$.

11. The daylighting device according to claim 10,
wherein the angles $\alpha$ and $\beta$ are such that $64°<\alpha\leq 90°$ and $42°\leq\beta 90°$.

12. The daylighting device according to claim 3, wherein:
the first and second faces of the prismatic structural bodies are provided so as to face indoors; and
each of the prismatic structural bodies has, at least in a part thereof, such a combination of the angles $\alpha$ and $\beta$ that $0<a\leq 90°$, $0°\leq\beta\leq 90°$, and $\alpha\leq\beta$.

13. The daylighting device according to claim 12, wherein the angles $\alpha$ and $\beta$ are such that $51°<\alpha\leq 83°$ and $33\leq\beta\leq 90°$.

14. The daylighting device according to claim 3, wherein the first transparent slat is bent along a bending line that is parallel to a lengthwise direction of the first transparent slat.

15. The daylighting device according to claim 14, wherein:

the first transparent slat has a first area and a second area separated by the bending line;

the prismatic structural bodies are provided in the first area; and the second area has a light-absorbing property.

16. The daylighting device according to claim 3, wherein the second face has a cross-section, taken perpendicular to a lengthwise direction of the prismatic structural bodies, that has a curved line.

17. The daylighting device according to claim 3, further comprising a direct-light-detection unit configured to detect direct light around the daylighting device, wherein the control unit controls the angle of inclination of the first transparent slat based on the direct light detected by the direct-light-detection unit.

18. A daylighting system comprising:

the daylighting device according to claim 1; and a multilayered glass unit including a pair of opposing glass plates separated by a distance, wherein the daylighting device is provided between the pair of glass plates.

19. A daylighting system comprising:

the daylighting device according to claim 1;

an interior lighting fixture;

a detection unit configured to detect indoor brightness; and a control unit configured to control the interior lighting fixture and the detection unit, wherein the control unit controls the interior lighting fixture based on an illuminance detected by the detection unit.

20. A daylighting device comprising:

a first transparent slat configured to bend an optical path of incident light from an outdoor direction so as to emit the incident light in a prescribed indoor direction;

a second slat provided below the first transparent slat, the second slat being configured to either block the incident light or transmit the incident light in a diffuse manner;

a drive mechanism configured to drive at least one of the first and second slats; and a control unit configured to control the drive mechanism so as to change an angle of inclination of the at least one of the first and second slats in accordance with a position of the sun, wherein:

the first transparent slat includes a plurality of prismatic structural bodies configured to change a traveling direction of light in a vertical plane; and the prismatic structural bodies each have at least:

a first face serving primarily as a reflection face for the incident light and making an angle $\alpha$ with a reference face for the first transparent slat; and a second face serving as an entrance face or an exit face for the incident light and making an angle $\beta$ with the reference face.

21. The daylighting device according to claim 20, wherein the second slat is driven in conjunction with or independently from the first transparent slat so as to change the angle of inclination of the second slat.

* * * * *